US008943985B2

(12) United States Patent
Hashimoto et al.

(10) Patent No.: US 8,943,985 B2
(45) Date of Patent: Feb. 3, 2015

(54) SEAM RAVEL PREVENTING METHOD, SEAM RAVEL PREVENTING APPARATUS AND SEAM STRUCTURE

(75) Inventors: Seiji Hashimoto, Osaka (JP); Koichi Hikichi, Osaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 0 days.

(21) Appl. No.: 14/114,694

(22) PCT Filed: Apr. 13, 2012

(86) PCT No.: PCT/JP2012/060100

§ 371 (c)(1),
(2), (4) Date: Oct. 29, 2013

(87) PCT Pub. No.: WO2012/160900

PCT Pub. Date: Nov. 29, 2012

(65) Prior Publication Data

US 2014/0076222 A1 Mar. 20, 2014

(30) Foreign Application Priority Data

May 23, 2011 (JP) ..... 2011-115174
Sep. 21, 2011 (JP) ..... 2011-206440

(51) Int. Cl.
*D05B 1/08* (2006.01)
*D05B 1/10* (2006.01)
*D05B 63/00* (2006.01)
(Continued)

(52) U.S. Cl.
CPC *D05B 1/10* (2013.01); *D05B 63/00* (2013.01); *D05B 61/00* (2013.01)
USPC ..... 112/475.17; 112/292; 112/165

(58) Field of Classification Search
CPC ..... D05B 57/02; D05B 57/06; D05B 73/12; D05B 65/00; D05B 65/02; D05B 65/003; B65H 69/04
USPC ..... 112/165, 197, 285, 286, 288, 291, 292, 112/298, 475.1, 475.17; 289/1.2, 1.5; 83/949, 950
See application file for complete search history.

(56) References Cited

U.S. PATENT DOCUMENTS 1,284,911 A * 11/1918 Lautenschlager ..... 112/475.15
1,920,784 A * 8/1933 De Voe ..... 112/437
(Continued)

FOREIGN PATENT DOCUMENTS

CN 1637189 A 7/2005
CN 1932113 A 3/2007
(Continued)

*Primary Examiner* — Ismael Izaguirre
(74) *Attorney, Agent, or Firm* — Bret E. Field; Bozicevic, Field & Francis LLP

(57) ABSTRACT

A thread hook and a looper thread holder are arranged on a rear side of a needle drop position of a sewing machine. When usual sewing is completed, the thread hook and the looper thread holder swing and move close to a looper. A hook part provided at a tip end of the thread hook holds a needle thread loop caught by the looper and positions it on an advance end side of the looper away from the needle drop position, and a thread receiving part provided at a tip end of the looper thread holder holds a looper thread extending from the looper to cloths and positions it on the front side away from the needle drop position. The sewing machine performs sewing for at least one stitch while maintaining positions of the needle thread loop and the looper thread.

18 Claims, 21 Drawing Sheets

(51) Int. Cl.
*D05B 61/00* (2006.01)
*D05B 65/00* (2006.01)

(56) References Cited

U.S. PATENT DOCUMENTS 5,381,745 A * 1/1995 Nolle ..... 112/475.17
5,881,663 A * 3/1999 Tsukioka et al. ..... 112/475.17
6,119,613 A 9/2000 Douyasu et al.
6,401,640 B2 * 6/2002 Tanaka ..... 112/200
6,422,165 B1 * 7/2002 Tanaka et al. ..... 112/470.01
6,814,018 B1 * 11/2004 Chuo ..... 112/292
7,404,367 B2 7/2008 Yasuzawa
7,497,177 B2 * 3/2009 Tanaka et al. ..... 112/292
2006/0231002 A1 10/2006 Tanaka et al.
2014/0076222 A1 3/2014 Hashitomo et al.

FOREIGN PATENT DOCUMENTS

CN 202671847 U 1/2013
JP H06233877 A 8/1994
JP 2879399 B2 1/1999
JP 11-057268 A 3/1999
JP 2006-314762 A 11/2006
JP 2011-206527 A 10/2011

* cited by examiner

SEAM RAVEL PREVENTING METHOD, SEAM RAVEL PREVENTING APPARATUS AND SEAM STRUCTURE

This application is the national phase under 35 U.S.C. §371 of PCT International Application No. PCT/JP2012/060100 which has an International filing date of Apr. 13, 2012 and designated the United States of America.

TECHNICAL FIELD

The present invention relates to a ravel preventing method for preventing ravel from occurring at a seam of a sewing end portion in seams of multi-thread chain stitching formed by a needle thread and a looper thread using a sewing machine, such as a multi-thread chain stitch sewing machine and a covering chain stitch sewing machine, to a ravel preventing apparatus for performing this method, and to a seam structure formed using these method and apparatus.

BACKGROUND ART

A multi-thread chain stitch sewing machine is equipped with one or more needles that rise and fall while holding needle threads and a looper that holds a looper thread and advances and retracts in a direction substantially orthogonal to the up-down movement pathways of the needles. The needles fall while passing through cloths to be sewn on a needle plate and rise so as to get out of the cloths to be sewn. The looper advances and retracts under the needle plate in synchronization with the rising and falling of the needles, and catches the loops of the needle threads (needle thread loops) held by the rising needles at the time of advance. The needles fall while passing through the cloths to be sewn and catch the looper thread held by the retracting looper.

The multi-thread chain stitch sewing machine repeats the above-mentioned operation to form seams on the cloths. FIGS. 1A and 1B are plan views showing seam structures of twin-needle multi-thread chain stitching, seen from the back side of sewn cloths. As shown in FIGS. 1A and 1B, seams of the multi-thread chain stitching are formed when needle thread loops formed by needle threads 20 and 20 on the back side of the sewn cloths are intertwined with a looper thread 10 in a form of inter-looping. In the general seam structure of multi-thread chain stitching shown in FIG. 1A, in the case that an end portion of a looper thread 10 that was cut at the end of sewing is pulled as indicated by the arrow shown in FIG. 1A, the looper thread 10 slips out of the last needle thread loops 20*a* and 20*b* formed by the needle threads 20 and 20. This slipping-out proceeds sequentially toward the sewing start side. As a result, there is a problem that ravel occurs in the whole seams.

Such ravel occurs similarly in seams of multi-thread chain stitching formed using three or more needle threads and a looper thread, and also occurs similarly in general sewing machines for forming a seam of multi-thread chain stitching, such as a covering chain stitch sewing machine.

Conventionally, various ravel preventing methods and various ravel preventing apparatuses for performing these methods have been proposed to prevent the above-mentioned occurrence of ravel peculiar to seams of multi-thread chain stitching. As one of the proposals, a ravel preventing method and a ravel preventing apparatus proposed by the present applicant are available (see Japanese Patent No. 2879399, for example). In this ravel preventing method, a looper thread hook is provided to hold a looper thread that was passed through needle thread loops by the advance of a looper at the advance end portion of the looper. The looper thread hook is operated in a state in which the needles have risen and the looper has advanced at the end of usual sewing. In a state in which the looper thread is held by the looper thread hook, sewing for one stitch is performed, and then the needle threads and the looper thread are cut.

With this method, during sewing for one stitch the looper thread 10 held by the looper thread hook is intertwined with the last needle thread loops 20*a* and 20*b* formed by the needle threads 20 and 20 in a form of interlacing, and the seams as shown in FIG. 1B are formed. The looper thread 10 intertwined in this manner cannot slip out of the last needle thread loops 20*a* and 20*b* even if an end portion thereof is pulled as indicated by the arrow. As a result, seam ravel can be prevented at the stage of occurrence.

SUMMARY

As described above, the ravel preventing method proposed in Japanese Patent No. 2879399 is an excellent method capable of effectively preventing the occurrence of ravel peculiar to seams of multi-thread chain stitching. However, even in the seams formed as shown in FIG. 1B, in the case that the force indicated by the hollow arrow shown in FIG. 1B is applied, there is a problem that the cut end portion of the looper thread 10 may slip out of the last needle thread loops 20*a* and 20*b*. After this slipping-out has occurred, as in the case of the general seam of multi-thread chain stitching, the slipping-out of the looper thread 10 proceeds sequentially toward the sewing start side. As a result, ravel occurs in the whole seams.

This problem is apt to occur in the case that the tension forces applied to the needle threads 20 and 20 and the looper thread 10 are made small to obtain an excellent finish state, for example, in the sewing of thin cloths to be sewn and soft cloths to be sewn. This is because the tightening of the looper thread 10 using needle thread loops 20*a* and 20*b* becomes insufficient in the case that the applied tension forces are made small.

The present invention has been made with the aim of solving the above problems, and it is an object of the present invention to provide a new ravel preventing method capable of effectively preventing the occurrence of ravel peculiar to a seam of multi-thread chain stitching without being affected by the tension forces applied to a needle thread and a looper thread, to provide a ravel preventing apparatus to be used for performing this method, and to provide a seam structure formed by these method and apparatus.

The seam ravel preventing method according to the present invention is a seam ravel preventing method for preventing ravel of a seam of multi-thread chain stitching formed when a needle thread loop formed under a needle plate by a needle that moves up and down while holding a needle thread is caught by a looper advancing in a direction substantially orthogonal to an up-down movement pathway of the needle and then the needle thread loop is subjected to inter-looping with a looper thread held by the looper, said seam ravel preventing method comprising: a first step of, when sewing of a cloth is completed, advancing the looper, positioning a needle thread loop caught by the looper on an advance end side of the looper away from a fall position of the needle, and positioning a looper thread extending from the looper to the cloth on a front side away from the fall position of the needle; and a second step of, after the first step, performing sewing for at least one stitch while maintaining positions of the needle thread loop and the looper thread until the needle falls and passes through the needle thread loop, and subjecting the needle thread loop held by the looper to self-looping with the needle thread held by the needle.

The seam ravel preventing method according to the present invention is characterized in that the needle thread loop caught by the looper is positioned on the advance end side of the looper away from the fall position of the needle on a rear side or a front side of the looper.

Furthermore, the seam ravel preventing method according to the present invention is characterized in that a plurality of the needles are disposed in a direction in which the looper advances, and at least one of a plurality of needle thread loops formed by the respective needles, including the needle thread loop positioned on the advance end side of the looper, is positioned on the advance end side of the looper away from the fall positions of the needles.

Furthermore, the seam ravel preventing method according to the present invention is characterized in that the sewing for at least one stitch at the second step is performed while feeding of the cloth is stopped or a feed pitch of the cloth is made smaller than that used before the first step.

Furthermore, the seam ravel preventing method according to the present invention is characterized in that stop of the feeding of the cloth or feeding of the cloth at the feed pitch smaller than that used before the first step is performed from a stage before the sewing for at least one stitch at the second step.

Furthermore, the seam ravel preventing method according to the present invention is characterized in that, after the looper thread is positioned on the front side away from the fall position of the needle, feeding of the looper thread to the looper is restrained.

The seam ravel preventing apparatus according to the present invention is a seam ravel preventing apparatus for preventing ravel of a seam of multi-thread chain stitching, said seam ravel preventing apparatus being installed in a sewing machine which comprises a needle that moves up and down while holding a needle thread and a looper that holds a looper thread and advances and retracts in a direction substantially orthogonal to an up-down movement pathway of the needle and in which a needle thread loop formed under a needle plate by the needle is caught by the advancing looper and the needle thread loop is subjected to inter-looping with the looper thread held by the looper to form a seam of multi-thread chain stitching on a cloth, said seam ravel preventing apparatus comprising: a needle-thread holding mechanism that approaches to and recedes from the looper, and holds a needle thread loop caught by the looper on an advance end side of the looper away from a fall position of the needle when the needle-thread holding mechanism approaches to the looper; a looper-thread holding mechanism that approaches to and recedes from the looper, and holds a looper thread extending from the looper to a cloth on a front side away from the fall position of the needle; and a control section for controlling approaching/receding of the needle-thread holding mechanism and the looper-thread holding mechanism in association with operations of the needle and the looper and feeding of the cloth, wherein after first sewing is completed with the looper located at an advance position thereof and the needle located at a rise position thereof, the control section causes the needle-thread holding mechanism and the looper-thread holding mechanism to approach to the looper and hold a needle thread loop and a looper thread respectively, and provides control of maintaining a state where the needle-thread holding mechanism and the looper-thread holding mechanism hold the needle thread loop and the looper thread respectively until the needle falls and passes through the needle thread loop and performing second sewing for at least one stitch in the maintained state while synchronizing falling/rising of the needle with advancing/retracting of the looper and the feeding of the cloth.

In addition, the seam ravel preventing apparatus according to the present invention is characterized in that when a plurality of the needles are disposed in a direction in which the looper advances, the needle-thread holding mechanism holds at least one needle thread loop including the needle thread loop formed by the needle positioned on the advance end side of the looper.

Furthermore, the seam ravel preventing apparatus according to the present invention is characterized in that for the second sewing for at least one stitch, the control section sets a feed pitch of the cloth to zero or a value smaller than that used for the first sewing.

Furthermore, the seam ravel preventing apparatus according to the present invention is characterized in that the control section sets the feed pitch of the cloth to zero or a value smaller than that used for the first sewing from a stage before the second sewing for at least one stitch.

Furthermore, the ravel preventing apparatus according to the present invention is characterized in that the needle-thread holding mechanism comprises: a thread hook and a stopper lever that are disposed under the needle plate and swing on a plane substantially parallel with the needle plate; a hook actuator for swinging the thread hook from a wait position away from the looper, to a thread hook position close to the looper; and a stopper actuator for swinging the stopper lever from a retraction position away from a range in which the thread hook swings, to a restraint position for making contact with a part of the thread hook, wherein the control section selectively controls the hook actuator and the stopper actuator to cause the thread hook to hold the needle thread loop caught at the thread hook position by the thread hook, at a hold position between the thread hook position and the wait position by contact with the stopper lever.

Furthermore, the ravel preventing apparatus according to the present invention is characterized in that the needle-thread holding mechanism comprises: a thread hook that is disposed under the needle plate and swings on a plane substantially parallel with the needle plate; a swinging lever and a stopper lever that are disposed at positions further away from the needle plate than the thread hook and swing on a plane substantially parallel with the needle plate; a connecting rod for connecting the thread hook to the swinging lever; a hook actuator for acting on the thread hook via the connecting rod and for swinging the thread hook from a wait position away from the looper, to a thread hook position close to the looper; and a stopper actuator for swinging the stopper lever from an engagement position where the stopper lever is engaged with a part of the swinging lever, to a retraction position away from the engagement position, and wherein the control section selectively controls the hook actuator and the stopper actuator to cause the thread hook to hold the needle thread loop caught at the thread hook position by the thread hook, at a hold position between the thread hook position and the wait position by engagement of the stopper lever and the swinging lever.

Furthermore, the ravel preventing apparatus according to the present invention is characterized in that the looper-thread holding mechanism comprises a looper thread holder that is mounted on the thread hook and moves among the thread hook position, the hold position and the wait position together with the thread hook, and the looper thread holder catches the looper thread extending from the looper to the cloth while moving from the wait position to the thread hook position, and holds the caught looper thread at the hold position on the front side away from the fall position of the needle.

Furthermore, the ravel preventing apparatus according to the present invention is characterized in that the looper thread holder is mounted so that a position thereof is adjustable with respect to the thread hook.

The seam structure according to the present invention is a seam structure of multi-thread chain stitching formed on a cloth using the seam ravel preventing method or the seam ravel preventing apparatus described above, wherein a needle thread loop, at least located last in a sewing direction, of needle thread loops formed on a back side of the cloth is subjected to self-looping with a needle thread passing through the cloth.

In the seam ravel preventing method and the seam ravel preventing apparatus according to the present invention, after sewing is completed in a state where the looper advances, a sewing operation is performed in a state in which the needle thread loop caught by the looper is positioned on the advance end side of the looper away from the fall position of the needle and the looper thread extending from the looper to the cloth is positioned on the front side away from the fall position of the needle, and the preceding needle thread loop is subjected to self-looping with the needle thread held by the falling needle, whereby the looper thread is held by a self-looping portion and the looper thread can be prevented from slipping out. As a result, ravel of a seam can be prevented securely at the stage of the occurrence. The looper thread is held properly by the self-looping of the needle thread even in the case that the tension applied to the needle thread and the looper thread is small, whereby the occurrence of ravel can be prevented.

In addition, in the seam ravel preventing method and the seam ravel preventing apparatus according to the present invention, when the number of the needle thread loops is plural, at least the needle thread loop positioned on the advance end side of the looper is positioned as described above. Hence, self-looping can be performed securely, and ravel of a seam can be prevented further securely.

Furthermore, in the seam ravel preventing method according to the present invention, after the looper thread is positioned as described above, the feeding of the looper thread to the looper is restrained. Hence, the position of the looper thread can be securely maintained, self-looping can be performed without being affected by the existence of the looper thread, the occurrence of ravel can be prevented securely, the tension of the looper thread can be strengthened, and the slipping-out of the looper thread itself can also be prevented. As a result, the length of the looper thread after cutting becomes short, whereby the appearance of the seam becomes attractive and the quality of the seam can be improved.

Furthermore, in the seam ravel preventing method and the seam ravel preventing apparatus according to the present invention, the above-mentioned sewing operation for ravel prevention is performed while the feeding of the cloth is stopped or the feed pitch of the cloth is made small, whereby the self-looping portion formed of the needle thread becomes dense. As a result, the holding of the looper thread is strengthened, and the occurrence of ravel starting from the slipping-out of the looper thread at the sewing end portion can be prevented further securely.

Furthermore, in the seam ravel preventing method and the seam ravel preventing apparatus according to the present invention, the stop of the feeding of the cloth or the reduction in the feed pitch of the cloth is performed from the stage before the above-mentioned sewing operation for ravel prevention, whereby the self-looping portion formed of the needle thread and the inter-looping portion ahead of the self-looping portion become dense. As a result, the holding of the looper thread is strengthened, and the occurrence of ravel starting from the slipping-out of the looper thread at the sewing end portion can be prevented further securely.

Furthermore, in the seam ravel preventing apparatus according to the present invention, the needle thread is held by the thread hook and the stopper lever swinging on the plane parallel with the needle plate and is positioned as described above. Hence, the positioning of the needle thread can be attained by using a simple configuration that can be disposed in the limited space under the needle plate. Additionally, the thread hook and the stopper lever respectively should only swing between two positions. Hence, the configurations of the respective actuators and the configuration of the control section for controlling these can also be simplified. As a result, the occurrence of seam ravel can be prevented by the simple configurations.

Furthermore, in the seam ravel preventing apparatus according to the present invention, the needle thread is held by the operations associated with the thread hook, the swinging lever and the stopper lever that swing on the plane parallel with the needle plate and is positioned as described above. Hence, the positioning of the needle thread can be attained by using a simple configuration that can be disposed in the limited space under the needle plate. Furthermore, since the swinging lever and the stopper lever are disposed away from the needle plate and the thread hook should only be disposed near the needle plate, the apparatus is applicable to a sewing machine, the space of which under the needle plate is further limited, such as a sewing machine equipped with a cylindrical bed.

Furthermore, in the seam ravel preventing apparatus according to the present invention, the looper thread is held by the looper thread holder that is mounted on the thread hook and operates together with the thread hook and is positioned as described above. Hence, the looper thread can be positioned together with the needle thread by a simple configuration.

Furthermore, in the seam ravel preventing apparatus according to the present invention, since the position of the looper thread holder is adjusted with respect to the thread hook, the relative position between the needle thread and the looper thread can be set properly. Hence, self-looping can be performed securely and seam ravel can be prevented.

Furthermore, in the seam structure according to the present invention, since the self-looping portion formed of the needle thread is provided at the end portion in the sewing direction, the looper thread can be prevented from slipping out, and the occurrence of seam ravel starting from the slipping-out of the looper thread can be prevented securely. Therefore, the present invention brings about an excellent effect.

DETAILED DESCRIPTION

Figure 2:
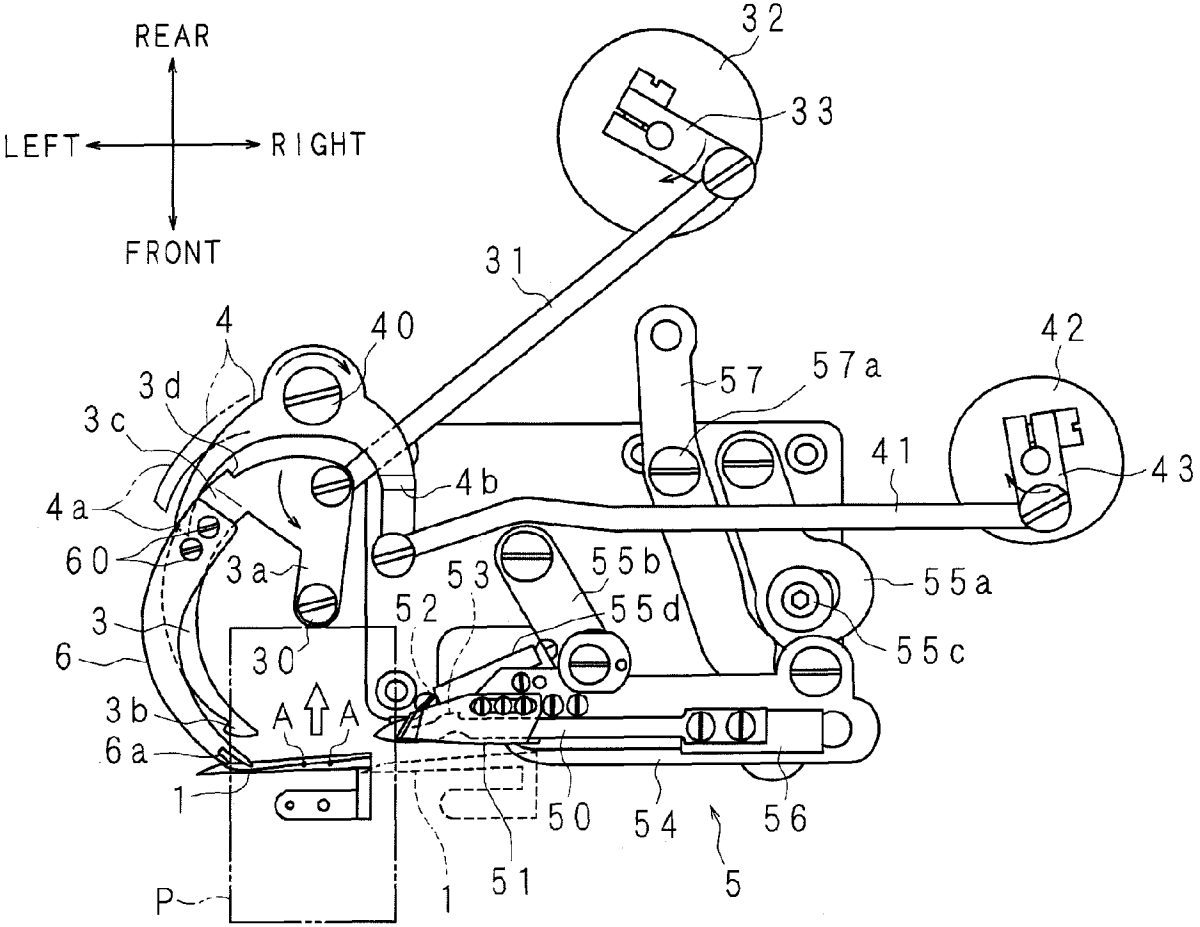
FIG. 2 is a plan view schematically showing the configurations of the main parts of a seam ravel preventing apparatus according to Embodiment 1.
Figure 3:
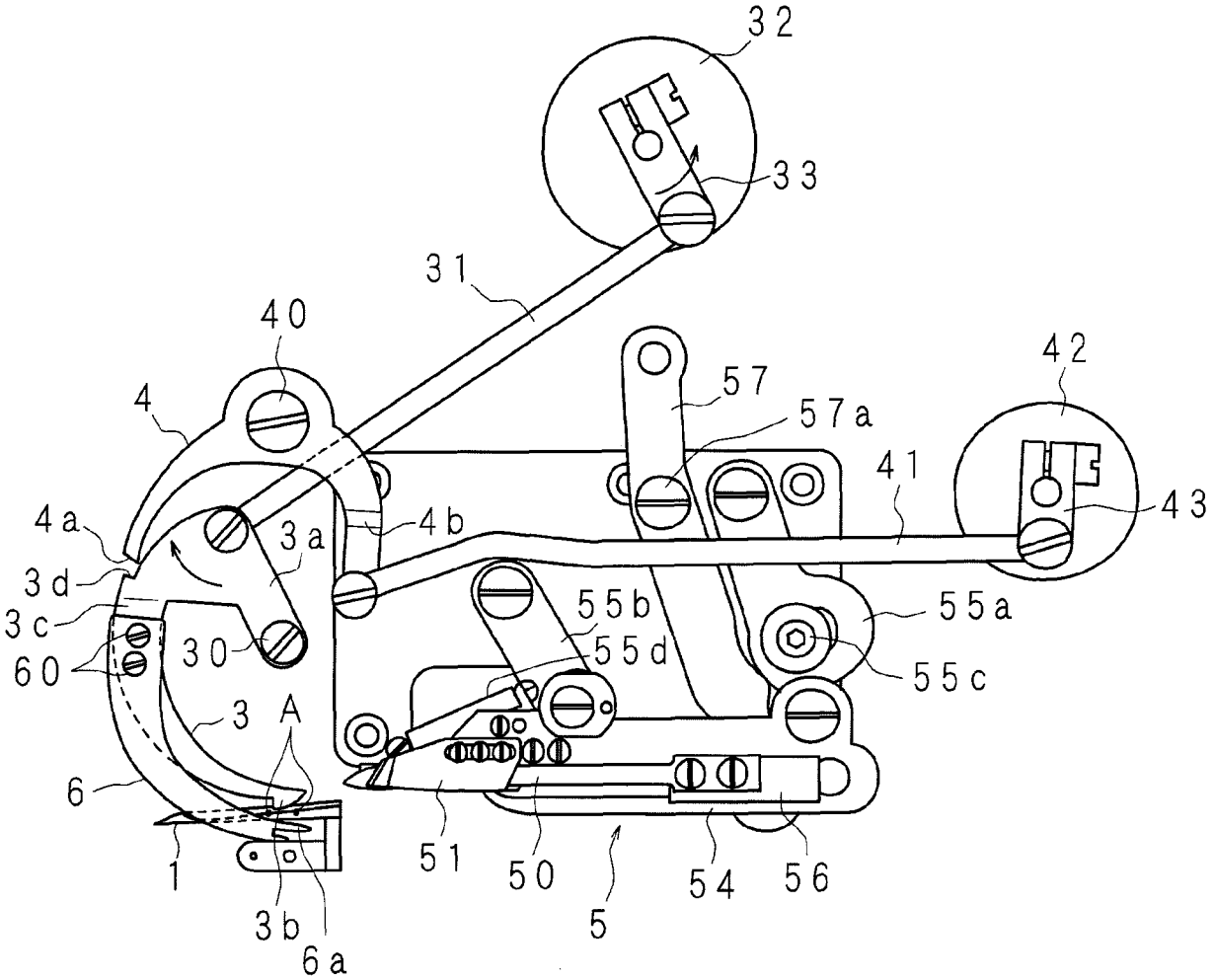
FIG. 3 is a plan view schematically showing the configurations of the main parts of the seam ravel preventing apparatus according to Embodiment 1.
Figure 4:
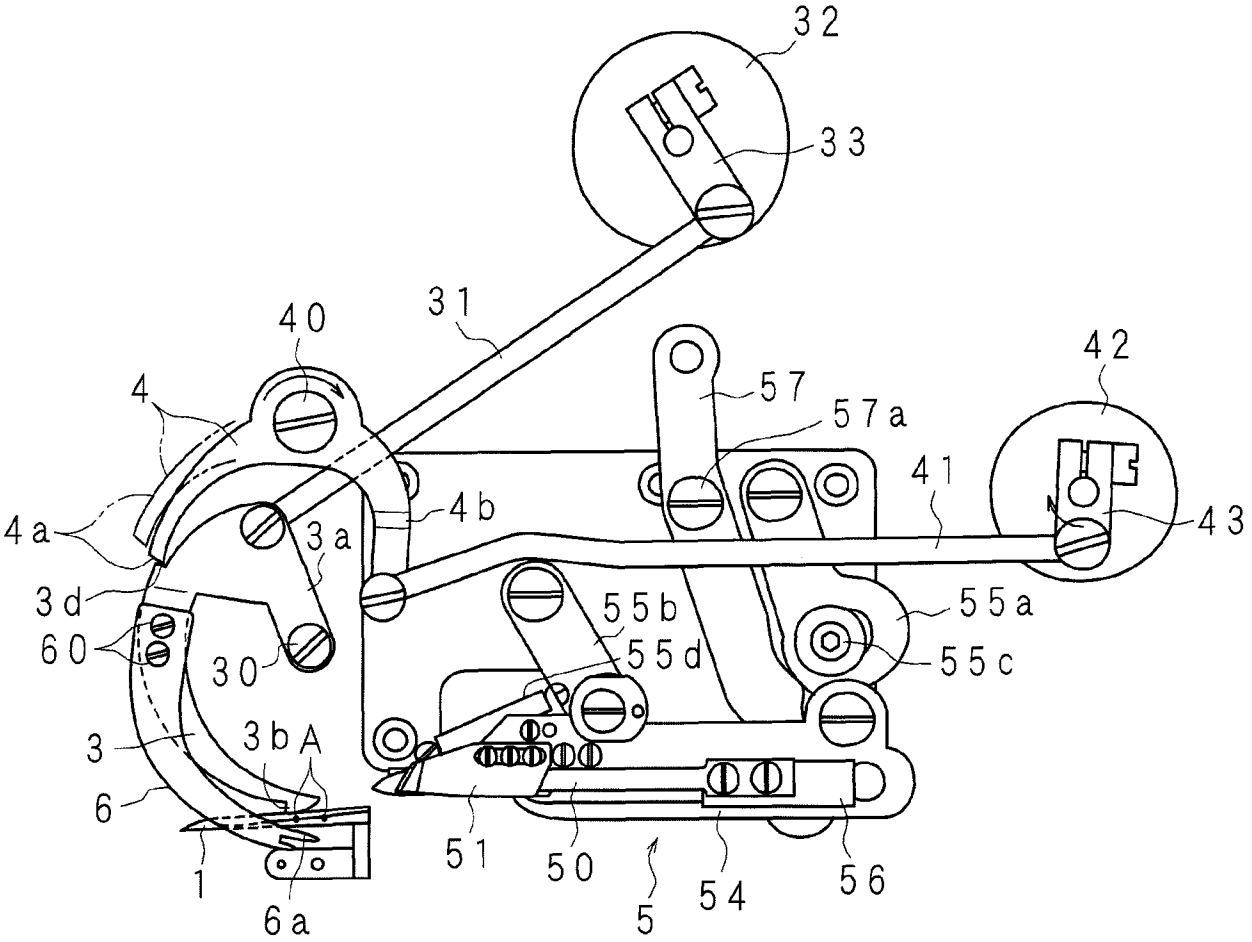
FIG. 4 is a plan view schematically showing the configurations of the main parts of the seam ravel preventing apparatus according to Embodiment 1.

The present invention will be described below on the basis of the drawings illustrating embodiments thereof. FIGS. 2 to 4 are plan views schematically showing the configuration of a seam ravel preventing apparatus according to Embodiment 1, seen from above. The apparatus shown in the figures is configured so as to be installed in a sewing machine for forming a seam of multi-thread chain stitching, such as a multi-thread chain stitch sewing machine or a covering chain stitch sewing machine. In the following descriptions, "left and right" and "front and rear" directions indicated by the arrows shown in FIG. 2 are used. The "front" direction is on the side close to the sewing machine operator, and the "rear" direction is on the side away from the sewing machine operator. The "left and right" directions are on the "left and right" sides as viewed from the front.

The sewing machine is equipped with one looper 1 and two needles 2 and 2 (refer to FIGS. 7 to 13). The two needles 2 and 2 rise and fall through the operation of a needle bar drive mechanism. Characters A and A in FIGS. 2 to 4 indicate the fall positions (needle drop positions) of the needles 2 and 2. The needle drop positions A and A are set at a substantially central position of a needle plate P with a distance therebetween in the left-right direction.

The looper 1 shown in the figure performs advancing/retracting operation (left-advancing/right-retracting operation) in the alignment direction of the needles 2 and 2 (the needle drop positions A and A) through the operation of a looper drive mechanism. In FIG. 2, the looper 1 at its left advance position is indicated by solid lines, and the looper 1 at its right retraction position is indicated by broken lines. The tip end of the looper 1 at the left advance position extends leftward beyond the needle drop positions A and A of the needles 2 and 2, and the tip end of the looper 1 at the right retraction position is positioned rightward away from the needle drop positions A and A of the needles 2 and 2. The direction of the advancing/retracting operation of the looper 1 should only be a direction substantially orthogonal to the up/down movement pathway of the needle 2, and the configuration of the present invention described below can be accomplished regardless of the operation direction of the looper.

The sewing machine sews cloths to be sewn (not shown) on the needle plate P through the rising/falling operation of the needles 2 and 2 and the left-advancing/right-retracting operation of the looper 1. The cloths to be sewn are fed by the operation of a feeding mechanism provided inside a sewing machine bed rearward (in the direction indicated by the hollow arrow shown in FIG. 2) on the needle plate P. The feeding mechanism is equipped with a feed dog. The feed dog protrudes above the needle plate P and moves rearward and retracts below the needle plate P and then returns forward; this operation is repeated. A movement force is applied to the cloths to be sewn only while the feed dog protrudes above the needle plate P, whereby the cloths are fed intermittently.

The needle bar drive mechanism, the looper drive mechanism and the feeding mechanism are known mechanisms operating in synchronization with one another by virtue of power transmission from the main shaft of the sewing machine. The needles 2 and 2 respectively hold needle threads 20 and 20 (refer to FIGS. 7 to 13), pass through the cloths to be sewn while the feeding is stopped, reach the lower side of the needle plate P, and then rises, thereby getting out upward from the cloths to be sewn. The looper 1 holds a looper thread 10 (refer to FIGS. 7 to 13), advances leftward when the needles 2 and 2 start rising, and catches the loops of the needle threads 20 and 20 formed under the needle plate P. After the getting-out of the needles 2 and 2, the cloths are fed. The needles 2 and 2 fall while passing through the cloths to be sewn that have been fed, and catch the looper thread 10 held by the looper 1 retracting rightward. The sewing machine repeats the above-mentioned operation and forms seams of multi-thread chain stitching on the cloths to be sewn.

The above-mentioned seam ravel preventing apparatus provided for the sewing machine is equipped with a thread hook 3 and a stopper lever 4. In the upper part of the sewing machine bed on the rear side of the needle plate P, the thread hook 3 is supported so as to swing around a support shaft 30 extending up and down. The stopper lever 4 is supported so as to swing around a support shaft 40 extending up and down and disposed behind the support shaft 30.

The thread hook 3 has a circularly-curved shape and is provided continuing to the end part of an arm 3*a* extending rearward from the support shaft 30 so as to bend in the left forward direction. The tip end part of the thread hook 3 is located so as to face the needle drop positions A and A of the needles 2 and 2 from the left rearward side, and a hook part 3*b* protruding outward is provided at the tip end part. The base part (the part provided continuing to the arm 3*a*) of the thread hook 3 is connected to a thread-handling solenoid 32 via a connecting rod 31. The thread-handling solenoid 32 is a rotary solenoid configured so as to obtain rotation output of a predetermined angle when a magnetizing current is applied. The thread-handling solenoid 32 is secured at the right rearward position of the thread hook 3 while the output end thereof is directed upward. A swinging arm 33 is secured to the output end of the thread-handling solenoid 32. The connecting rod 31 connects the middle part of the thread hook 3 to the tip end part of the swinging arm 33.

FIG. 2 shows a state in which the thread-handling solenoid 32 is demagnetized, and FIG. 3 shows a state in which the thread-handling solenoid 32 is magnetized. When the thread-handling solenoid 32 is in the demagnetized state, the swinging arm 33 is at the swing position shown in FIG. 2. When the thread-handling solenoid 32 is magnetized, the swinging arm 33 swings clockwise as indicated by the arrow shown in FIG. 2 and reaches the swing position shown in FIG. 3. The swinging motion of the swinging arm 33 is transmitted to the thread hook 3 via the connecting rod 31, and the thread hook 3 swings counterclockwise around the support shaft 30 as indicated by the arrow shown in FIG. 2, whereby the hook part 3*b* at the tip end of the thread hook 3 is positioned between the left and right needle drop positions A and A as shown in FIG. 3. In this way, the thread hook 3 swings from its wait position shown in FIG. 2 to its thread hook position shown in FIG. 3 in accordance with the magnetization of the thread-handling solenoid 32. The thread-handling solenoid 32 serves as to a hook actuator.

The stopper lever 4 has an arch shape concavely curved forward, the middle part of which is supported by the support shaft 40. The base part of the stopper lever 4 extending in the right forward direction is connected to a stopper solenoid 42 via a connecting rod 41. The stopper solenoid 42 is a rotary solenoid similar to the thread-handling solenoid 32, and the output end thereof is directed upward and secured at a position away from the stopper lever 4 rightward. A swinging arm 43 is secured to the output end of the stopper solenoid 42. The connecting rod 41 connects the base part of the stopper lever 4 to the tip end part of the swinging arm 43.

FIG. 2 shows a state in which the stopper solenoid 42 is demagnetized. When the stopper solenoid 42 is in the demagnetized state, the swinging arm 43 is at the swing position shown in FIG. 2. When the stopper solenoid 42 is magnetized, the swinging arm 43 swings clockwise as indicated by the arrow shown in FIG. 2. The swinging motion of the swinging arm 43 is transmitted to the stopper lever 4 via the connecting rod 41, and the stopper lever 4 swings clockwise around the support shaft 40 as indicated by the arrow shown in FIG. 2.

When the stopper solenoid 42 is in the demagnetized state, the tip end part 4*a* of the stopper lever 4 extending in the left forward direction overlaps with a part of the thread hook 3 located at the wait position as shown in FIG. 2. At the rear position of the part overlapping with the stopper lever 4, the thread hook 3 has a step part 3*c* that is provided so that its front side is raised. The tip end part 4*a* of the stopper lever 4 can overlap with the lower position of the thread hook 3 at the front position of the step part 3*c*. Furthermore, the stopper lever 4 has a step part 4*b* between the support shaft 40 and the base part thereof. The step part 4*b* is provided so that its rear side is raised and can intersect at the lower position of the connecting rod 31 as shown in FIG. 2.

When the thread hook 3 swings to the thread hook position, the stopper solenoid 42 is in the demagnetized state. The stopper lever 4 is pushed by the thread hook 3 and swings counterclockwise, whereby allows the swinging of the thread hook 3. After the thread hook 3 has passed, the stopper lever 4 is at the position (restraint position) indicated by the solid lines shown in FIG. 3. When the thread hook 3 swings to the thread hook position, the stopper lever 4 may be moved to the position (retraction position) indicated by the alternate long and two dashes lines shown in FIG. 2 by magnetizing the thread-handling solenoid 32 and the stopper solenoid 42. In this case, the thread hook 3 can swing without causing interference with the stopper lever 4. After the swinging of the thread hook 3 is completed, the stopper lever 4 reaches the restraint position by demagnetizing the stopper solenoid 42. The tip end part 4*a* of the stopper lever 4 at the restraint position is opposed to the rear side of a stop part 3*d* provided so as to protrude outward at the middle part of the thread hook 3. The stop part 3*d* of the thread hook 3 is provided on the rear side of the step part 3*c* and is substantially as high as the tip end part 4*a* of the stopper lever 4.

When the thread-handling solenoid 32 is demagnetized in the state shown in FIG. 3, the swinging arm 33 swings counterclockwise and the thread hook 3 swings clockwise as indicated by the arrows shown in FIG. 3. The swinging operations are restrained when the stop part 3*d* of the thread hook 3 makes contact with the tip end part 4*a* of the stopper lever 4, and the thread hook 3 stops at the hold position shown in FIG. 4. At this time, the hook part 3*b* at the tip end of the thread hook 3 moves from the thread hook position (between the left and right needle drop positions A and A) shown in FIG. 3 to the hold position (in the left rearward direction from the left needle drop position A) shown in FIG. 4, hooks the needle thread 20 of the left needle 2, and holds the needle thread at the position shown in FIG. 4 as described later. The hook part 3*b* of the thread hook 3 has a chamfered corner portion as shown in the figures, thereby preventing the needle threads 20 and 20 and the looper thread 10 that make contact therewith during the above-mentioned movement from being damaged.

When the stopper solenoid 42 is magnetized in the state shown in FIG. 4, the swinging arm 43 swings clockwise as indicated by the arrow shown in FIG. 4. By this swinging, the stopper lever 4 swings clockwise, and the tip end part 4*a* of the stopper lever 4 disengages from the stop part 3*d* of the thread hook 3 as indicated by the alternate long and two dashes lines shown in FIG. 4. Since the restraining of the thread hook 3 using the stopper lever 4 is released, the thread hook 3 returns to the wait position shown in FIG. 2. The stopper lever 4 returns to the position shown in FIG. 2 by demagnetizing the stopper solenoid 42. The above-mentioned sewing using the sewing machine is performed in the state shown in FIG. 2. The stopper solenoid 42 serves as a stopper actuator. As described above, the thread hook 3 moves among the wait position, the thread hook position and the hold position described above by selectively magnetizing the thread-handling solenoid 32 and the stopper solenoid 42.

A looper thread holder 6 is mounted on the thread hook 3 configured as described above. The looper thread holder 6 has a circularly-curved shape similar to that of the thread hook 3 and is secured to the upper face of the middle part of the thread hook 3 with fixing screws 60 and 60 passing through the base part and provided at two positions in the longitudinal direction of the base part. The tip end part of the looper thread holder 6 extends forward along the left side of the thread hook 3 and is located so as to face the needle drop positions A and A in front of the tip end part of the thread hook 3. A bi-forked thread receiving part 6*a* is provided at the tip end part of the looper thread holder 6. The position of the looper thread holder 6 with respect to the thread hook 3 can be adjusted by loosening the fixing screws 60 and 60. This position adjustment is performed so that the looper thread 10 is securely held by the thread receiving part 6*a* at the tip end part, as described later.

The looper thread holder 6 mounted in this way moves among the wait position, the thread hook position and the hold position described above together with the thread hook 3 through the operations of the thread-handling solenoid 32 and the stopper solenoid 42. At the thread hook position shown in FIG. 3, the thread receiving part 6*a* at the tip end of the looper thread holder 6 passes the upper part of the looper 1 and advances to the front side of the looper 1. At the hold position shown in FIG. 4, the thread receiving part 6*a* is positioned in front of the left needle drop position A.

The sewing machine is further equipped with a thread cutting mechanism 5. The thread cutting mechanism 5 is equipped with a thread cutting hook 50 and a thread cutting knife 51. The thread cutting hook 50 and the thread cutting knife 51 are mounted on a base 54 used in common. The base 54 is supported while the right end part and the middle part thereof are respectively connected to the front end parts of support arms 55*a* and 55*b*. The support arms 55*a* and 55*b* can swing around the respective support shafts thereof extending up and down and provided at the rear end parts. A range in which the right support arm 55*a* swings is restrained by a stopper screw 55*c* provided in the middle part. The left support arm 55*b* is pulled and biased leftward by a coil spring 55*d*.

The thread cutting knife 51 is a plate-shaped member secured to the left end part of the base 54 and has a blade part at the edge extending leftward. The thread cutting hook 50 is equipped with a first hook part 52 and a second hook part 53 protruding rearward at the tip end part thereof sandwiched between the base 54 and the thread cutting knife 51. The first and second hook parts 52 and 53 are positioned with a predetermined distance therebetween in the left-right direction. In FIG. 2, the first and second hook parts 52 and 53 overlapping with the lower position of the thread cutting knife 51 are indicated by broken lines.

The thread cutting hook 50 has an extension part extending rightward from the portion overlapping with the thread cutting knife 51, and the extension part is connected to one end (front end) of a thread cutting lever 57 via a slider 56 that slides in the left-right direction while using the base 54 as a guide. The thread cutting lever 57 is supported by a support arm 57*a* extending up and down at the middle part in the front-rear direction and can swing around the support arm 57*a*. Usually, by the biasing force of a return spring (not shown), the thread cutting lever 57 is positioned at the swing position shown in FIGS. 2 to 4 while the support arm 55*a* is used as a stopper. The thread cutting lever 57 swings clockwise through the operation of a thread cutting actuator 58 (refer to FIG. 5) connected to the other end (rear end) thereof.

The thread cutting hook 50 and the thread cutting knife 51 are at the wait position shown in FIGS. 2 to 4 during usual cloth sewing. The wait position is obtained when the thread cutting actuator 58 is not operated and when the thread cutting lever 57 is at the swing position shown in FIGS. 2 to 4. The thread cutting hook 50 and the thread cutting knife 51 move in the right rearward direction together with the base 54 by the action of the support arm 55*a* that swings rightward together with the thread cutting lever 57 and is positioned away from the advancing/retracting movement pathway of the looper 1. In addition, the thread cutting hook 50 moves rightward together with the slider 56 that is connected to the thread cutting lever 57, whereby a part of the tip end thereof is in a state of protruding from the blade part of the thread cutting knife 51 as shown in FIGS. 2 and 4.

The thread cutting lever 57 swings through the operation of the thread cutting actuator 58. By this swinging, the holding of the right support arm 55*a* is released. As a result, the thread cutting hook 50 and the thread cutting knife 51 move in the left forward direction together with the base 54 in response to the swinging of the left support arm 55*b* by the biasing of the coil spring 55*d* and are positioned on the advancing/retracting movement pathway of the looper 1. The thread cutting hook 50 moves leftward together with the slider 56 by the further swinging of the thread cutting lever 57, and the first and second hook parts 52 and 53 of the thread cutting hook 50 protrude to the left of the thread cutting knife 51.

When the thread cutting actuator 58 becomes a non-operating state, the thread cutting lever 57 swings counterclockwise by the action of the biasing force of the return spring. Hence, the thread cutting hook 50 performs right retracting operation and overlaps with the lower part of the thread cutting knife 51, and the thread cutting hook 50 and the thread cutting lever 57 move rearward together with the base 54 and return to the wait position shown in FIGS. 2 to 4.

Figure 5:
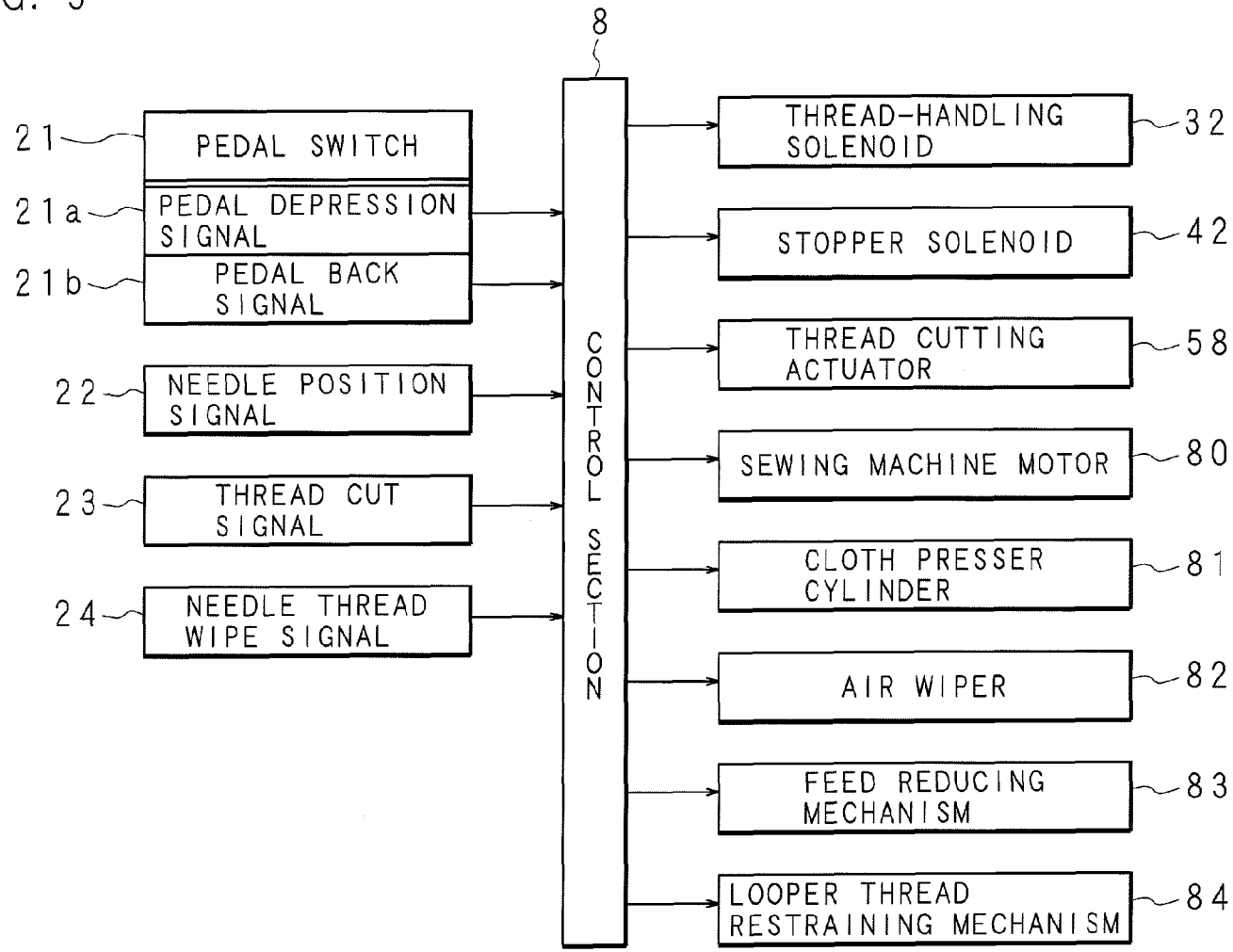
FIG. 5 is a block diagram showing the control system of a sewing machine equipped with the seam ravel preventing apparatus according to Embodiment 1.

FIG. 5 is a block diagram showing the control system of the sewing machine equipped with the seam ravel preventing apparatus configured as described above. A pedal depression signal 21*a* and a pedal back signal 21*b* given from a pedal switch 21, a needle position signal 22 given when the needles 2 and 2 are located near the top dead points thereof, and a thread cut signal 23 and a needle thread wipe signal 24 given as described later are respectively input to the control section 8 of the sewing machine.

On the other hand, the outputs of the control section 8 are respectively supplied to the thread-handling solenoid 32, the stopper solenoid 42 and the thread cutting actuator 58 described above. The thread hook 3 and the looper thread holder 6 operate as described above according to operation instructions respectively given from the control section 8 to the thread-handling solenoid 32 and the stopper solenoid 42. The thread cutting hook 50 advances and retracts as described above according to the operation instructions given from the control section 8 to the thread cutting actuator 58.

Furthermore, the outputs of the control section 8 are respectively supplied to a sewing machine motor 80 serving as the drive source of the main shaft of the sewing machine, a cloth presser cylinder 81 for raising/lowering a presser metal for pressing a cloth, an air wiper 82 for wiping up the needle threads 20 and 20 that are cut as described later, a feed reducing mechanism 83 for adjusting the feed amount of the cloths to be sewn, and a looper-thread restraining mechanism 84 for restraining the feed of the looper thread 10 to the looper 1. The sewing machine motor 80 is driven or stopped according to the operation instructions from the control section 8. Furthermore, the cloth presser cylinder 81, the air wiper 82, the feed reducing mechanism 83 and the looper-thread restraining mechanism 84 operate according to the operation instructions from the control section 8.

The feed reducing mechanism 83 is a known mechanism that is used to reduce the feed amount of the cloths to be sewn by changing the operation mode of the feed dog of the feeding mechanism. The feed reducing mechanism 83 operates, for example, so that the movement pathway of the feed dog is inclined with respect to the needle plate P so as to shorten the time in which the feed dog protrudes above the needle plate P. As a result, the time in which the feed dog acts on the cloths to be sewn on the needle plate P becomes short, and the feed pitch of the cloths to be sewn, that is, the feed amount of the cloths to be sewn during one-time operation of the feed mechanism becomes small.

The looper-thread restraining mechanism 84 is a known mechanism equipped with a thread tension disc for holding the middle part of the looper thread 10 that is fed to the looper 1 and an actuator that operates so as to increase or decrease the holding strength of the thread tension disc. The looper-thread restraining mechanism 84 raises the holding strength of the thread tension disc and increases the resistance applied to the looper thread 10, thereby restraining the feed of the looper thread 10.

At the end of the sewing, the control section 8 operates the thread hook 3 and the looper thread holder 6 in association with the sewing machine motor 80, the cloth presser cylinder 81, the air wiper 82, the feed reducing mechanism 83 and the looper-thread restraining mechanism 84, thereby executing the ravel preventing method according to the present invention.

Figure 6:
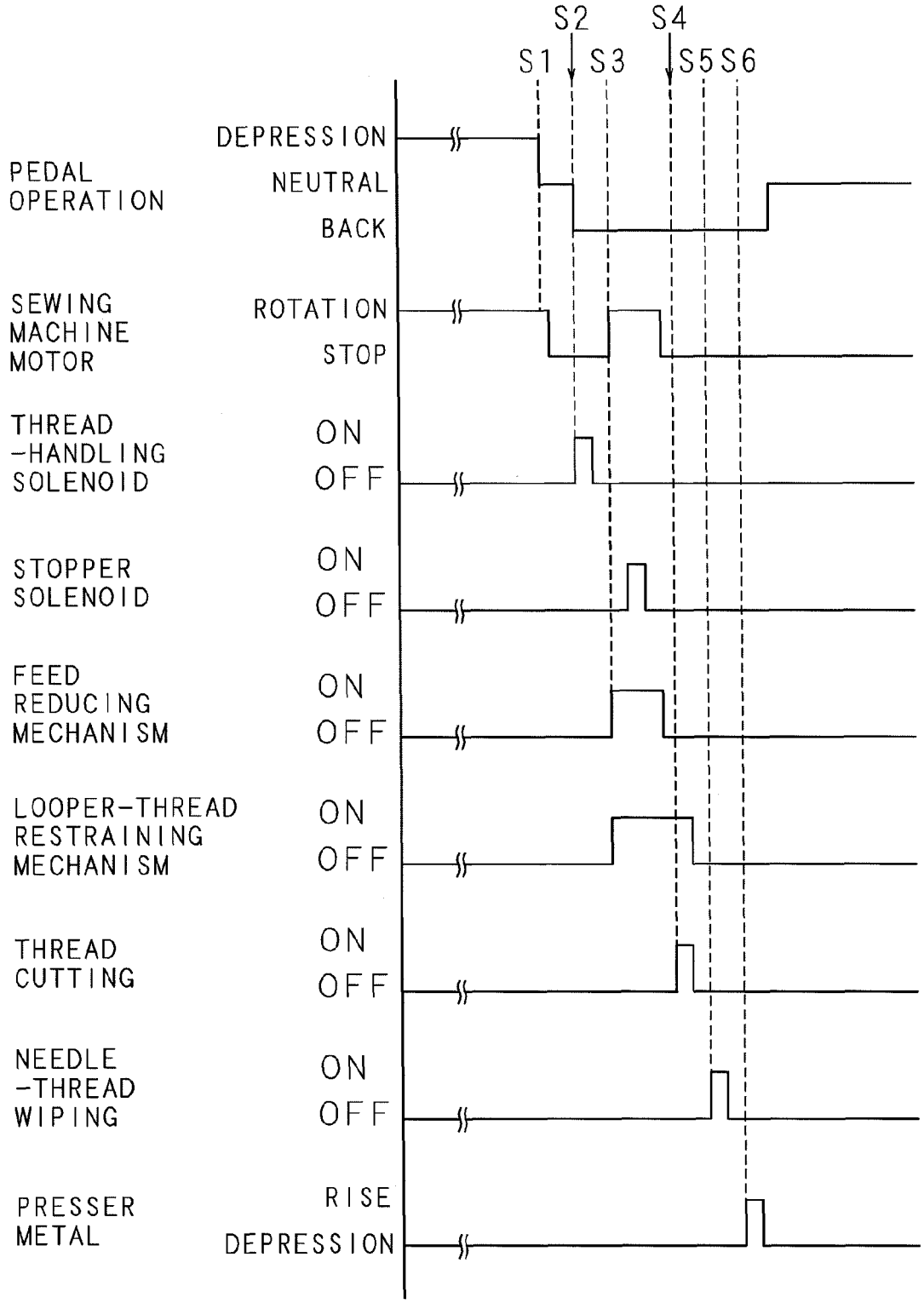
FIG. 6 is a time chart indicating the operations of a control section.

FIG. 6 is a time chart indicating the operations of the control section 8 for ravel prevention. The control section 8 is a computer equipped with a CPU, a ROM and a RAM. The ravel preventing operation according to the time chart shown in FIG. 6 is performed by a series of operations of the CPU according to control programs stored in the ROM. FIGS. 7 to 13 are explanatory views showing the operations of the apparatus according to the present invention and show the operation states of the thread hook 3 and the looper thread holder 6 and the operation state of the thread cutting hook 50 occurring during the operations of the control section 8 according to the time chart shown in FIG. 6.

When completing the sewing of the cloths, the sewing operator who uses the sewing machine stops the pedal depressing operation for driving the sewing machine. When the ravel preventing operation is performed thereafter, the sewing operator performs the pedal back operation. The pedal switch 21, attached to the pedal, outputs the pedal depression signal 21*a* while the pedal depressing operation is performed and outputs the pedal back signal 21*b* when the pedal back operation is performed.

When the sewing of the cloths is completed and when the pedal for driving the sewing machine is returned from its pedal depression state to its neutral state at time 51 shown in FIG. 6, that is, when the sewing machine is in a state in which neither the pedal depression signal 21*a* nor the pedal back signal 21*b* is given from the pedal switch 21, the control section 8 refers to the needle position signal 22 given to the input side and issues a stop instruction to the sewing machine motor 80 on the output side. As a result, the sewing machine stops temporarily in a state in which the needles 2 and 2 are located near the top dead points and the looper 1 has advanced leftward.

The control section 8 then waits until the pedal back operation is performed. When the pedal back operation is performed at time S2 shown in FIG. 6 and the pedal back signal 21*b* is given to the input side, the control section 8 starts the ravel preventing operation as described below. When the pedal depression signal 21*a* is input again from the pedal switch 21, the control section 8 returns to usual sewing. The sewing operator can continue the sewing of the cloths to be sewn by performing the pedal depressing operation again.

In FIG. 6, the neutral state is maintained between time S1 and time S2. However, maintaining the pedal at the neutral state described above is not an essential operation, and the pedal operation at the end of the sewing may be continuously shifted from the pedal depression state to the pedal back state. In this case, when the pedal passes through the neutral position in the process of the shifting, a no-signal state is present in which neither the pedal depression signal 21*a* nor the pedal back signal 21*b* is given. The control section 8 uses this no-signal state as a trigger and starts the ravel preventing operation after the needles 2 and 2 have risen near the top dead points and the looper 1 has advanced near the left advance end, as described above.

Furthermore, in the time chart shown in FIG. 6, the pedal back operation that is performed at time S2 continues while the ravel preventing operation described below is performed. However, the continuation of the pedal back operation is not an essential operation. The ravel preventing operation controlled by the control section 8 is performed continuously even after the input of the pedal back signal 21*b* is stopped.

Figure 1A:
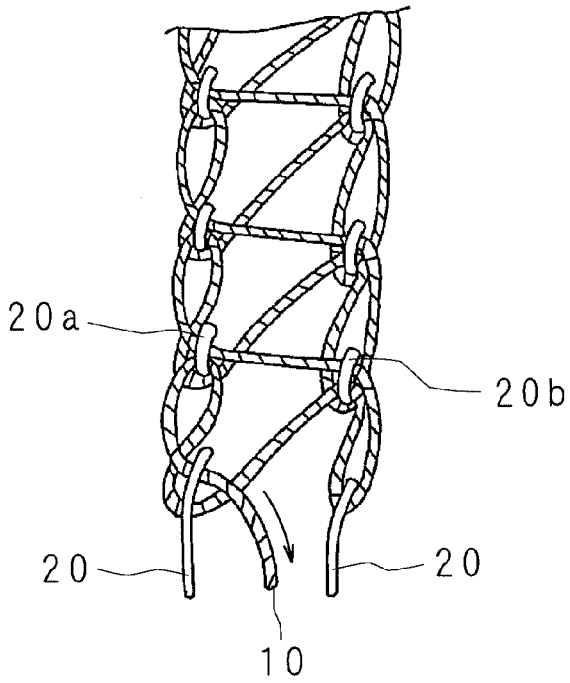
FIG. 1A PRIOR ART
FIG. 1A is a view showing general seams of sewing end portions, and the seam structures of the sewing end portions obtained by the conventional ravel preventing apparatus, seen from the back side of sewn cloths.
Figure 1B:
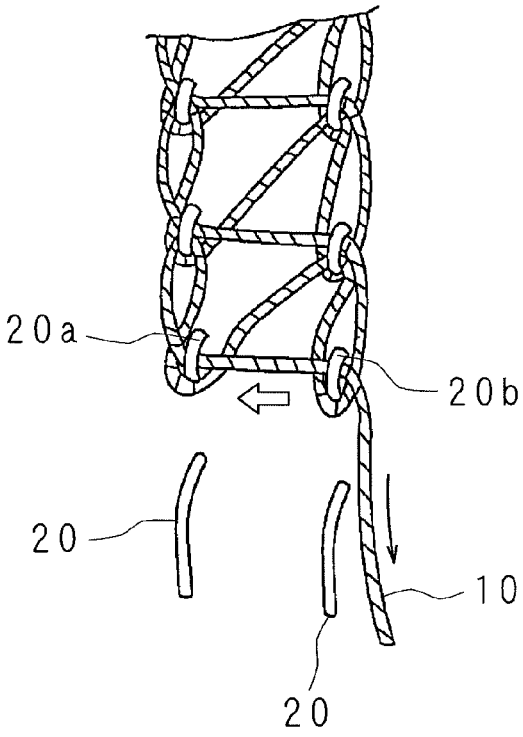
FIG. 1B PRIOR ART
FIG. 1B is a view showing general seams of sewing end portions, and the seam structures of the sewing end portions obtained by the conventional ravel preventing apparatus, seen from the back side of sewn cloths.
Figure 7:
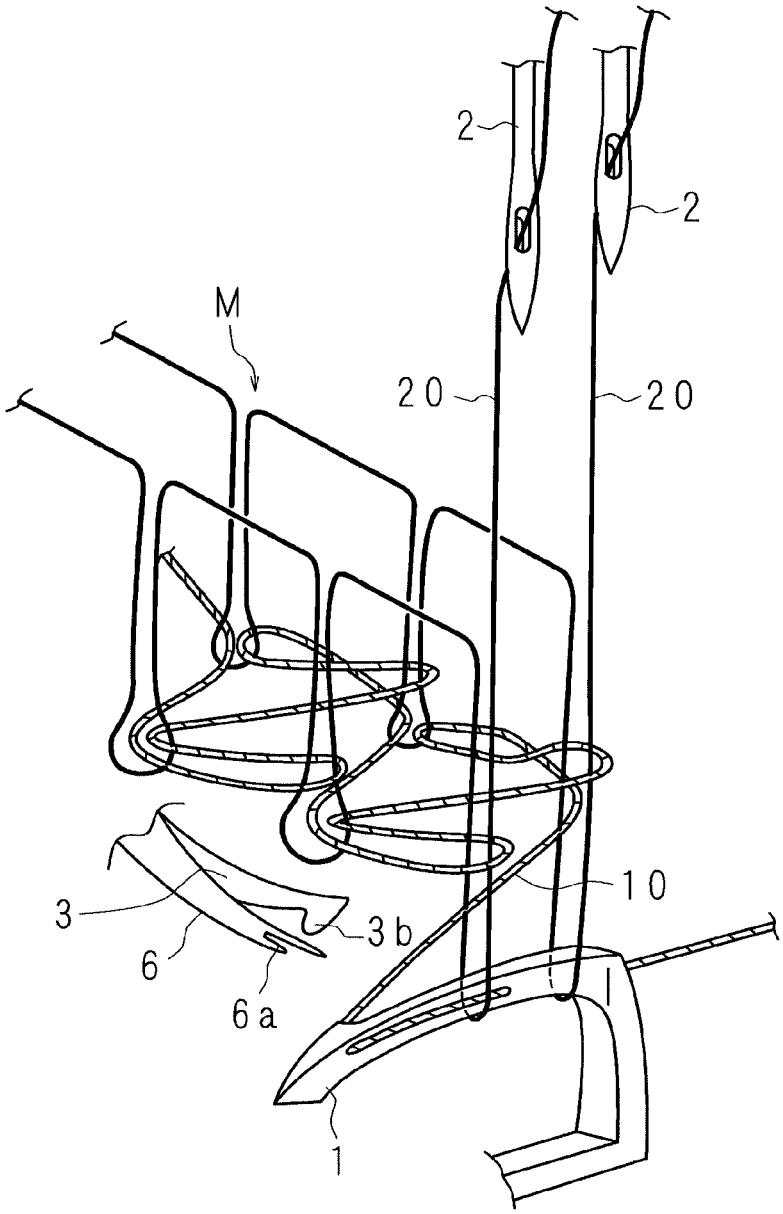
FIG. 7 is an explanatory view showing the operations of the seam ravel preventing apparatus.

FIG. 7 shows the states of the needles 2 and 2 and the looper 1 at the time of the start of the ravel preventing operation. The needles 2 and 2 are in a state of getting out upward from the cloths on which seams M of multi-thread chain stitching are formed by the two needle threads 20 and 20 and the looper thread 10. The looper 1 advances leftward on the lower side of the cloths, and is in a state of catching the two needle thread loops respectively formed by the needle threads 20 and 20. When the needle threads 20 and 20 and the looper thread 10 are cut in this state, the sewing end portion shown in FIG. 1A described above is formed.

After the start of the ravel preventing operation, the control section 8 first gives an operation instruction to the thread-handling solenoid 32 on the output side and magnetizes the thread-handling solenoid 32 for a short time. By the magnetization of the thread-handling solenoid 32, the thread hook 3 and the looper thread holder 6 move from the wait position shown in FIG. 2 to the thread hook position shown in FIG. 3. This movement is performed while the tip end part 4*a* of the stopper lever 4 is pressed and expanded leftward as described above.

After the thread hook 3 has passed, the stopper lever 4 moves to the restraint position indicated by the solid lines in FIG. 3 by the action of the spring force of a return spring (not shown). The thread hook 3 and the looper thread holder 6 swing clockwise and return by the demagnetization of the thread-handling solenoid 32. This swinging is restrained when the stop part 3*d* of the thread hook 3 makes contact with the tip end part 4*a* of the stopper lever 4 located at the restraint position, whereby the thread hook 3 and the looper thread holder 6 stop at the hold position shown in FIG. 4.

Figure 8:
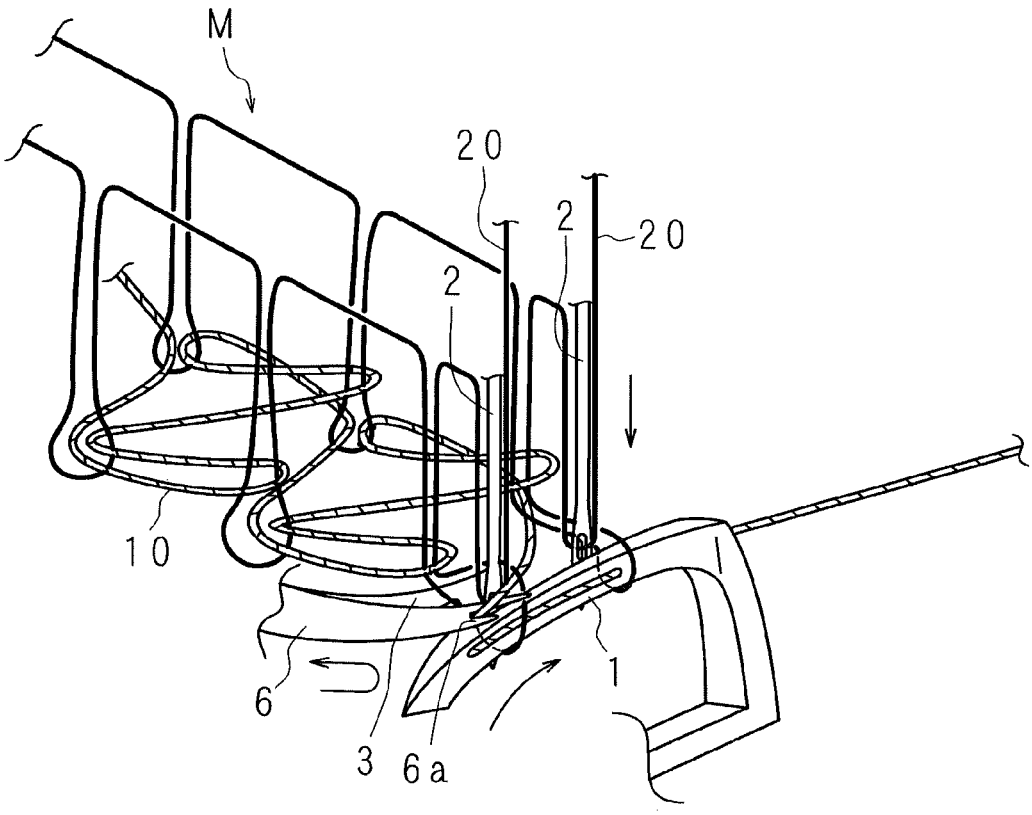
FIG. 8 is an explanatory view showing the operations of the seam ravel preventing apparatus.

FIG. 8 shows the thread hook 3 and the tip end part of the looper thread holder 6 having moved to the thread hook position and returned to the hold position. The hook part 3*b* at the tip end of the thread hook 3 that moves to the thread hook position as described above passes above the looper 1 from the left side of the looper 1, reaches a position between the needle drop positions A and A of the left and right needles 2 and 2 and is located beyond the needle thread loops on the advance end side of the looper 1. While the hook part 3*b* of the thread hook 3 moves from the thread hook position to the left rearward side and returns to the hold position, the hook part 3*b* hooks and holds the left needle thread loop and then positions the loop to the advance end side of the looper 1 away from the fall position (the needle drop position A) of the left needle 2.

On the other hand, the thread receiving part 6*a* at the tip end of the looper thread holder 6 that moves to the thread hook position is located above and in front of the tip end part of the looper 1 away from the left side of the looper 1. The thread receiving part 6*a* having a bi-forked shape catches the looper thread 10 extending from the tip end part of the looper 1 to the cloths and pushes the looper thread 10 forward while the thread receiving part 6*a* moves to the thread hook position. The thread receiving part 6*a* moves from the thread hook position to the left rearward side and returns to the hold position, and the looper thread 10 held by the thread receiving part 6*a* is positioned on the front side of the fall position (the needle drop position A) of the left needle 2 as shown in FIG. 8.

After the thread hook 3 has been operated as described above, the control section 8 gives operation instructions to the sewing machine motor 80, the feed reducing mechanism 83 and the looper-thread restraining mechanism 84 on the output side at time S3 shown in FIG. 6. These operation instructions are given with reference to the needle position signal 22 while the needles 2 and 2 fall and then rise and are positioned again near the top dead points. As a result, the cloths to be sewn are sewn for one stitch. Furthermore, this sewing operation is performed while the feed amount is made less than that used during usual sewing since the feed reducing mechanism 83 operates. Moreover, the sewing operation is performed in a state in which the feeding of the looper thread 10 to the looper 1 is restrained since the looper-thread restraining mechanism 84 operates. This restraint of the feeding is performed to prevent the looper thread 10 held by the thread receiving part 6*a* from loosening and to prevent the looper thread 10 from being displaced. As a result, the appearance of the seam to be formed becomes attractive and the quality of the seam can be improved.

The holding of the needle threads 20 and 20 and the looper thread 10 shown in FIG. 8 by the thread hook 3 and the looper thread holder 6 continues until the feeding movement of the cloths is completed, the left and right needles 2 and 2 pass through the cloths and fall, the left needle 2 passes through the loop of the needle thread 20 held by the thread hook 3 and catches the loop. At this time, the looper thread 10 held by the looper thread holder 6 is positioned so as to cross the front side of the left needle 2 as shown in FIG. 8. Hence, the left needle 2 does not catch the looper thread 10, and the looper thread 10 is caught only by the right needle 2 on the rear side of the looper 1.

Figure 9:
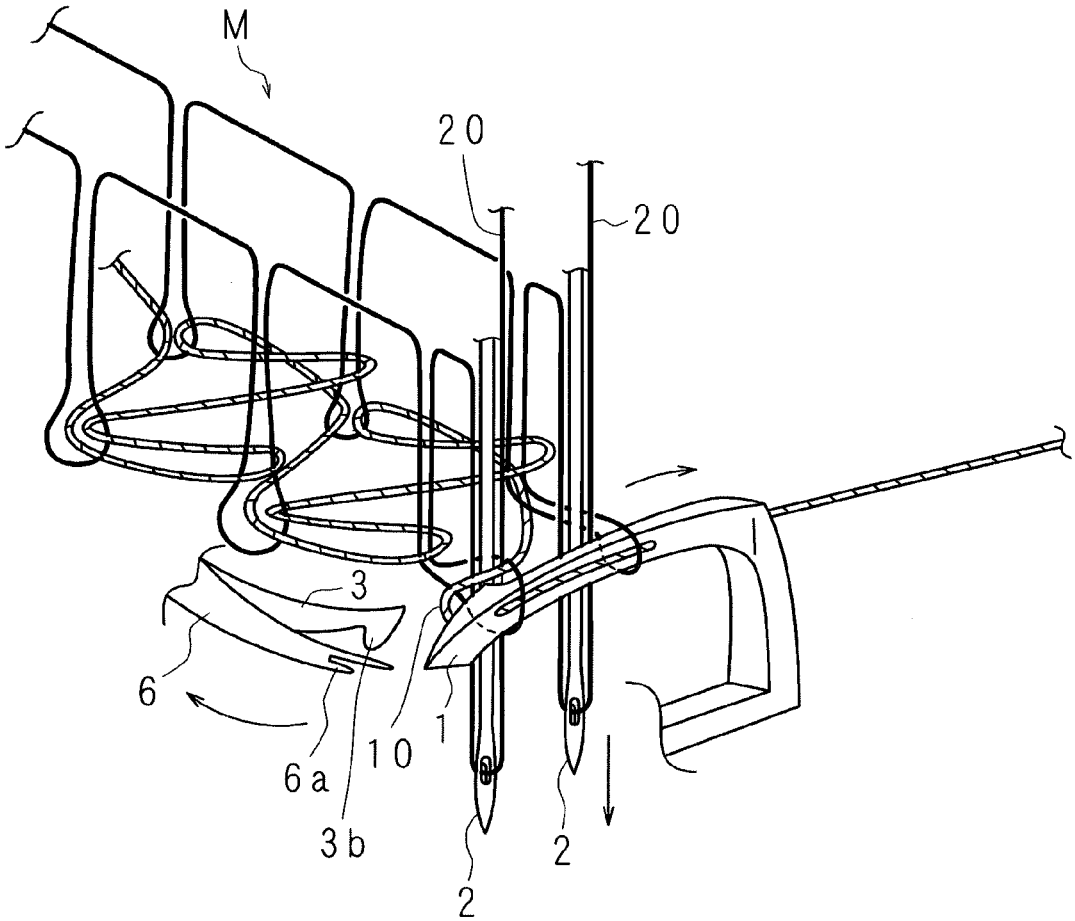
FIG. 9 is an explanatory view showing the operations of the seam ravel preventing apparatus.

The control section 8 gives an operation instruction for a short time to the stopper solenoid 42 at the timing when the left needle 2 catches the needle thread loop and magnetizes the stopper solenoid 42. By this magnetization, the stopper lever 4 moves from the restraint position indicated by the solid lines in FIG. 4 to the retraction position indicated by the alternate long and two dashes lines in FIG. 4, thereby releasing the restraining of the thread hook 3. As a result, the thread hook 3 and the looper thread holder 6 return from the hold position to the wait position as shown in FIG. 9, thereby releasing the holding of the needle thread loop and the looper thread 10.

Figure 10:
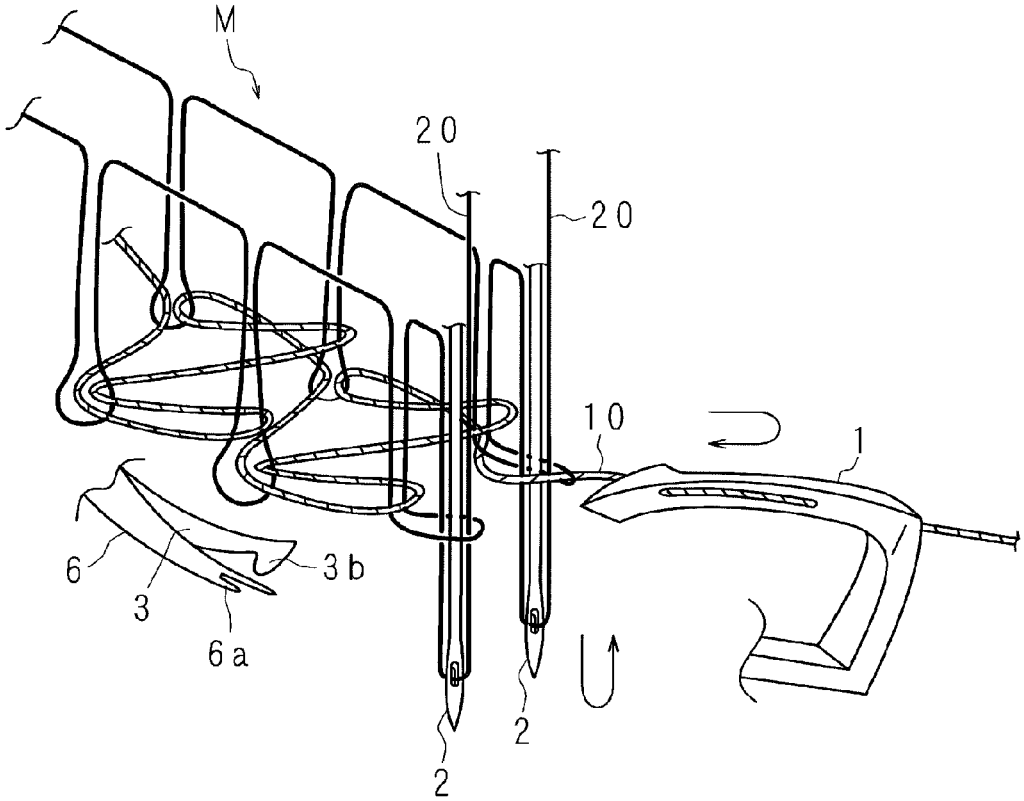
FIG. 10 is an explanatory view showing the operations of the seam ravel preventing apparatus.

The looper 1 retracts rightward in synchronization with the falling of the needles 2 and 2 and gets out of the caught needle thread loops. By this getting out, as shown in FIG. 10, the right needle 2 is in a state of catching the looper thread 10 as in the case of usual sewing. However, the left needle 2 is in a state of catching not the looper thread 10 but the loop of the needle thread 20.

Figure 11:
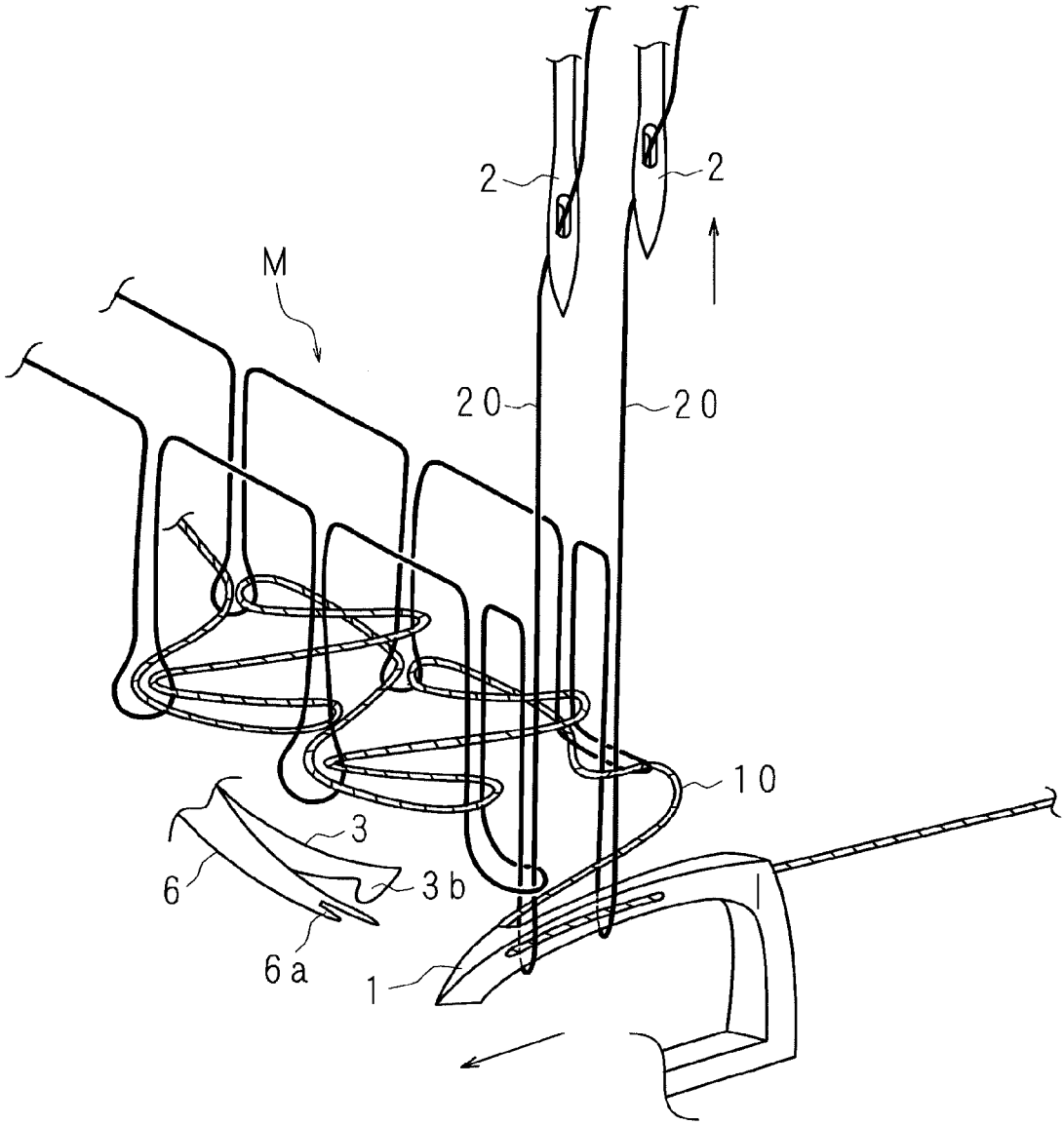
FIG. 11 is an explanatory view showing the operations of the seam ravel preventing apparatus.

In this state, the looper 1 advances leftward, and the needles 2 and 2 rise upward. As shown in FIG. 11, the looper 1 advancing leftward catches the loops of the left and right needle threads 20 and 20, and the needles 2 and 2 rising upward get out above the cloths. As a result, at the position of the right needle 2, the needle thread 20 caught by the looper 1 is subjected to inter-looping with the looper thread 10, and at the position of the left needle 2, the needle thread 20 caught by the looper 1 is subjected to self-looping with the loop of the needle thread 20 formed previously.

Sewing for one stitch is completed in a state in which the needles 2 and 2 have risen near the top dead points and the looper 1 has reached near the left advance end. Then, the control section 8 waits until the thread cut signal 23 is given. When the thread cut signal 23 is given at time S4 shown in FIG. 6, the control section 8 gives an operation instruction to the thread cutting actuator 58 on the output side to cause the thread cutting actuator 58 to perform its predetermined operation. As a result, the thread cutting hook 50 advances leftward and then retracts rightward.

Figure 12:
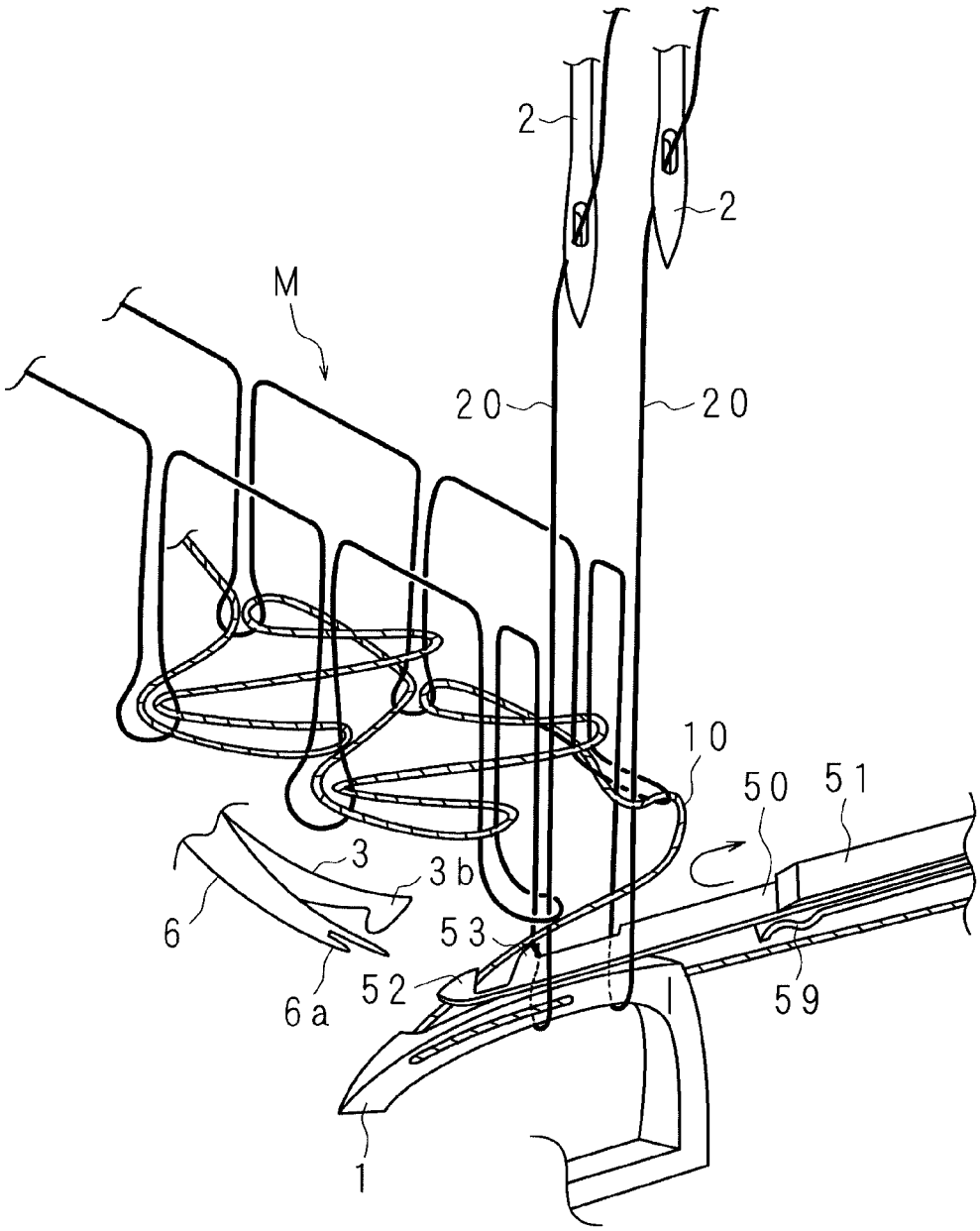
FIG. 12 is an explanatory view showing the operations of the seam ravel preventing apparatus.

The thread cutting hook 50 advancing leftward reaches the advance end shown in FIG. 12 along the upper part of the looper 1. At this time, the first hook part 52 provided at the tip end part of the thread cutting hook 50 passes through the loops of the needle threads 20 and 20 held by the looper 1 and reaches the left side of the looper thread 10 extending from the tip end of the looper 1 to the cloths. The second hook part 53 provided in the middle part of the thread cutting hook 50 is opposed to the left needle thread 20 on the left side.

Figure 13:
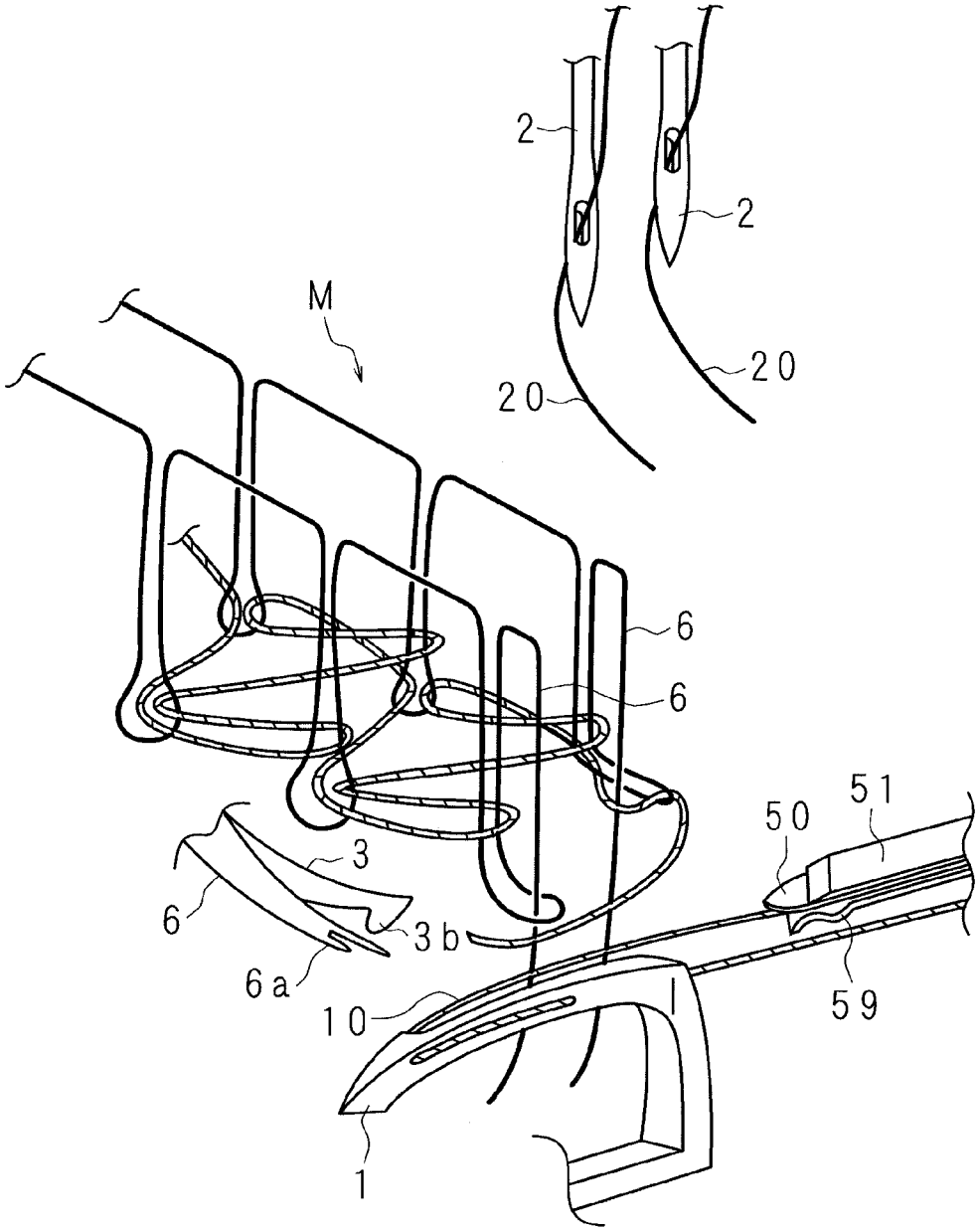
FIG. 13 is an explanatory view showing the operations of the seam ravel preventing apparatus.

After reaching the advance end, the thread cutting hook 50 retracts rightward. The first hook part 52 catches the looper thread 10, and the second hook part 53 catches the two needle threads 20 and 20 sequentially. The looper thread 10 and the needle threads 20 and 20 caught as described above are pulled to the retraction end of the thread cutting hook 50. At this time, as shown in FIG. 13, the needle threads 20 and 20 caught by the second hook part 53 make sliding contact with the blade part at the tip end of the thread cutting knife 51 and are cut. Furthermore, the looper thread 10 caught by the first hook part 52 similarly makes sliding contact with the blade part at the tip end of the thread cutting knife 51 and is cut. At the same time, these threads are held on the side of the looper 1 away from the cut position. The thread cutting mechanism 5 equipped with the thread cutting hook 50 and the thread cutting knife 51 cuts the needle threads 20 and 20 and the looper thread 10 by performing the above-mentioned operation.

The looper-thread restraining mechanism 84 continues its operation until the above-mentioned thread cutting operation is completed, and applies a predetermined tension to the looper thread 10 extending from the tip end of the looper 1 to the cloths. The first hook part 52 at the tip end of the thread cutting hook 50 can securely catch the looper thread 10 that is not loosened.

As shown in FIGS. 12 and 13, the thread cutting hook 50 is pushed against the sliding contact part of the thread cutting knife 51 by the spring force of a leaf spring 59 making elastic contact with the front side on the lower face thereof. Hence, the cutting of the needle threads 20 and 20 and the looper thread 10 by the thread cutting knife 51 is performed securely while being pushed by the leaf spring 59. The cut looper thread 10 is held in a state of being sandwiched between the lower face of the thread cutting hook 50 and the leaf spring 59 as shown in FIG. 13.

After the cutting operation is completed as described above, the control section 8 waits until the needle thread wipe signal 24 is given. When the needle thread wipe signal 24 is given at time S5 shown in FIG. 6, the control section 8 issues an operation instruction to the air wiper 82 on the output side, thereby operating the air wiper 82. The air wiper 82 blows air to wipe up the cut ends of the needle threads 20 and 20 leading to the sides of the needles 2 and 2. Then, the control section 8 issues an operation instruction to the cloth presser cylinder 81 on the output side at time S6 shown in FIG. 6, operates the cloth presser cylinder 81, and raises the presser metal, thereby completing a series of operations.

As a result, the operator removes the sewn cloths from on the needle plate P and sets new cloths to be sewn, whereby the operator can start the next sewing. At this time, the looper thread 10 is held under the needle plate P by the thread cutting hook 50 and the leaf spring 59, and the needle threads 20 and 20 are wiped up above the needle plate P and droop from the respective needles 2 and 2 as shown in FIG. 13. Hence, the operator can start the next sewing without requiring any treatment for the needle threads 20 and 20 and the looper thread 10.

The cutting of the needle threads 20 and 20 and the looper thread 10 using the thread cutting mechanism 5, the wiping up of the needle threads 20 and 20 through the operation of air wiper 82 and the raising of the presser metal through the operation of the cloth presser cylinder 81 are not essential operations required in the present invention. Furthermore, in this embodiment, upon the input of the thread cut signal 23 and the needle thread wipe signal 24 given from the outside, these operations are performed following the ravel preventing operation. However, these operations may be performed as a series of operations corresponding to the appropriate operations conducted by the operator after sewing for one stitch for ravel preventing operation is completed.

Figure 14:
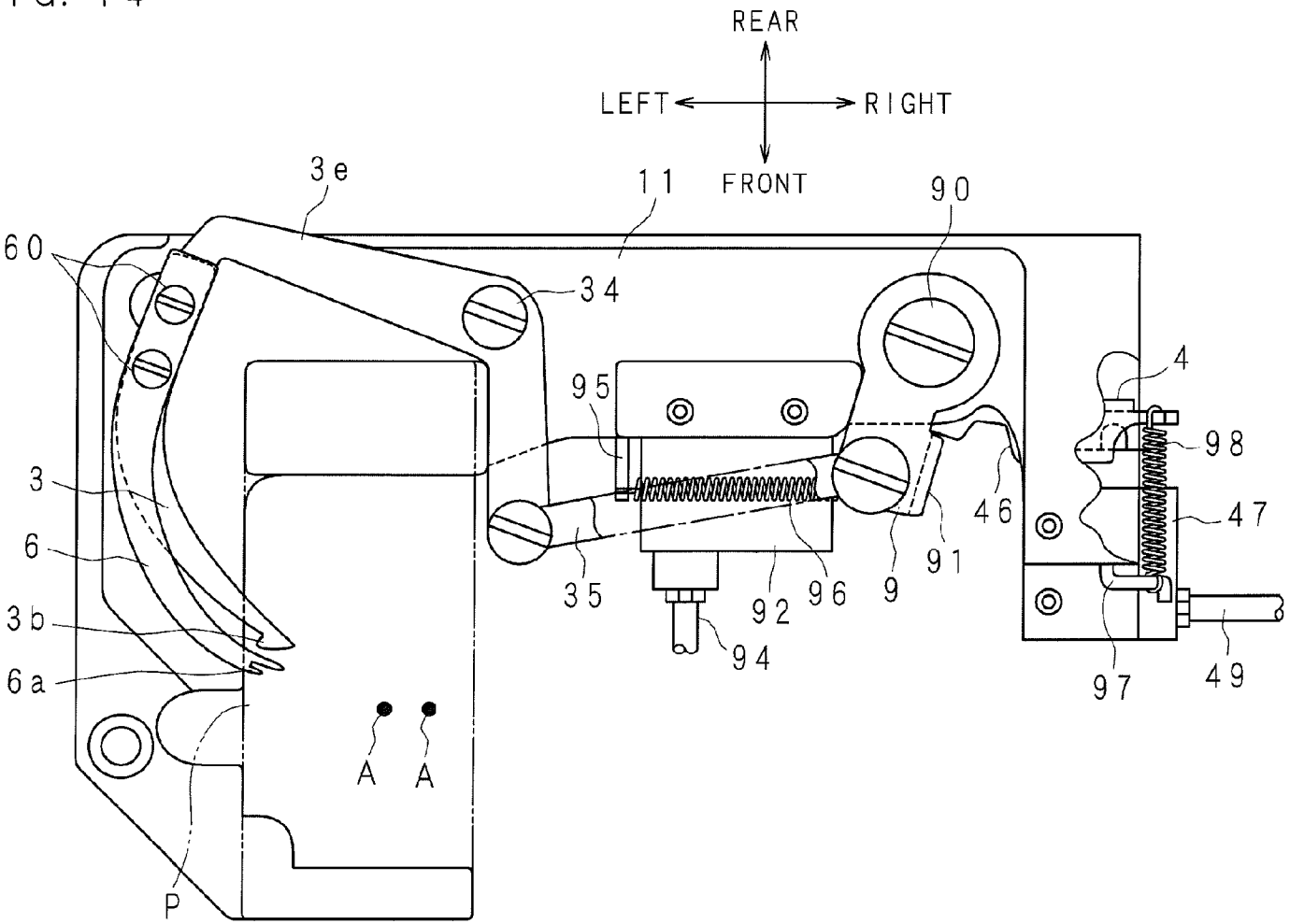
FIG. 14 is a plan view schematically showing the configurations of the main parts of a seam ravel preventing apparatus according to Embodiment 2, seen from above.
Figure 15:
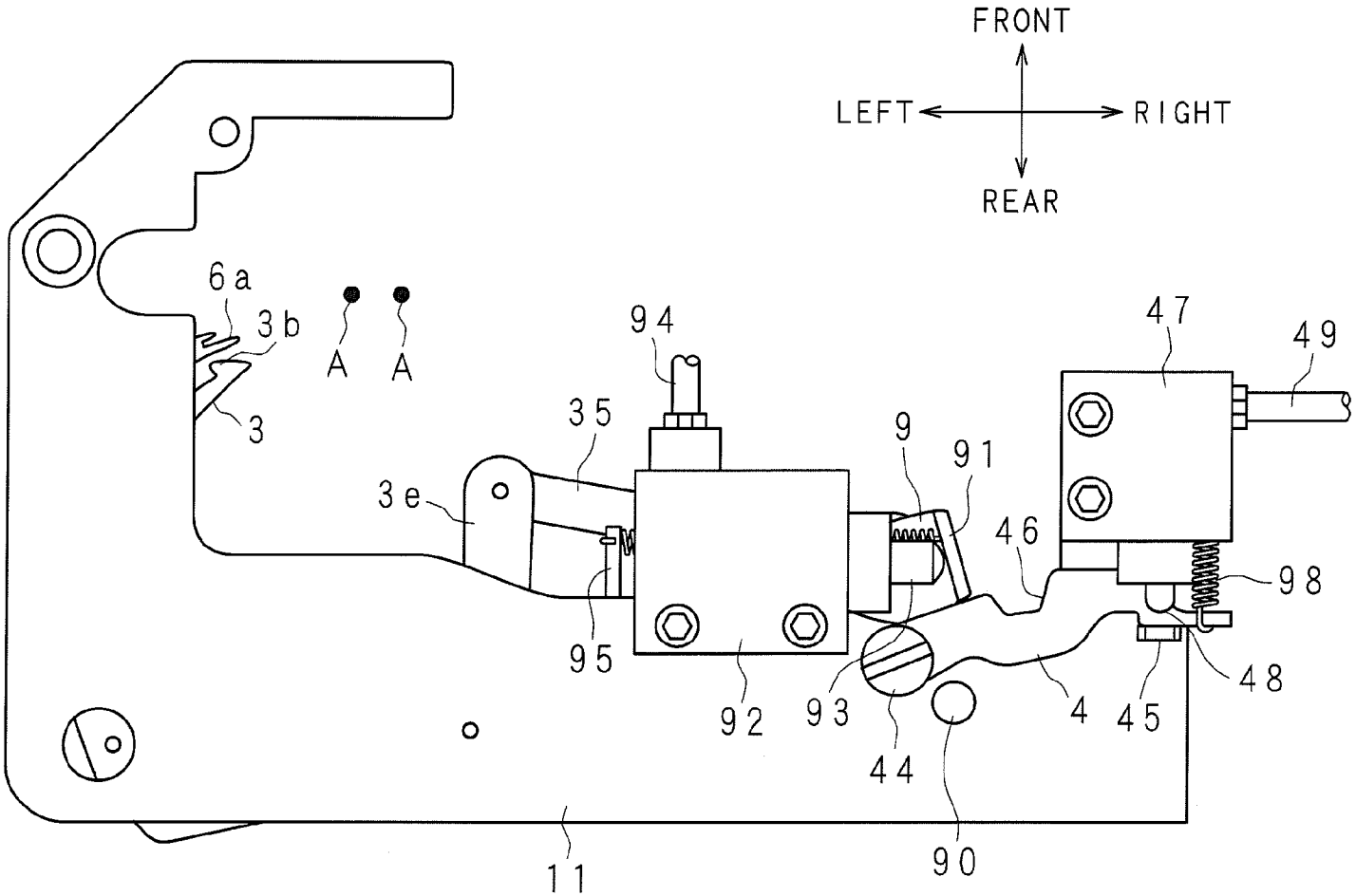
FIG. 15 is a plan view schematically showing the configurations of the main parts of the seam ravel preventing apparatus according to Embodiment 2, seen from below.
Figure 16:
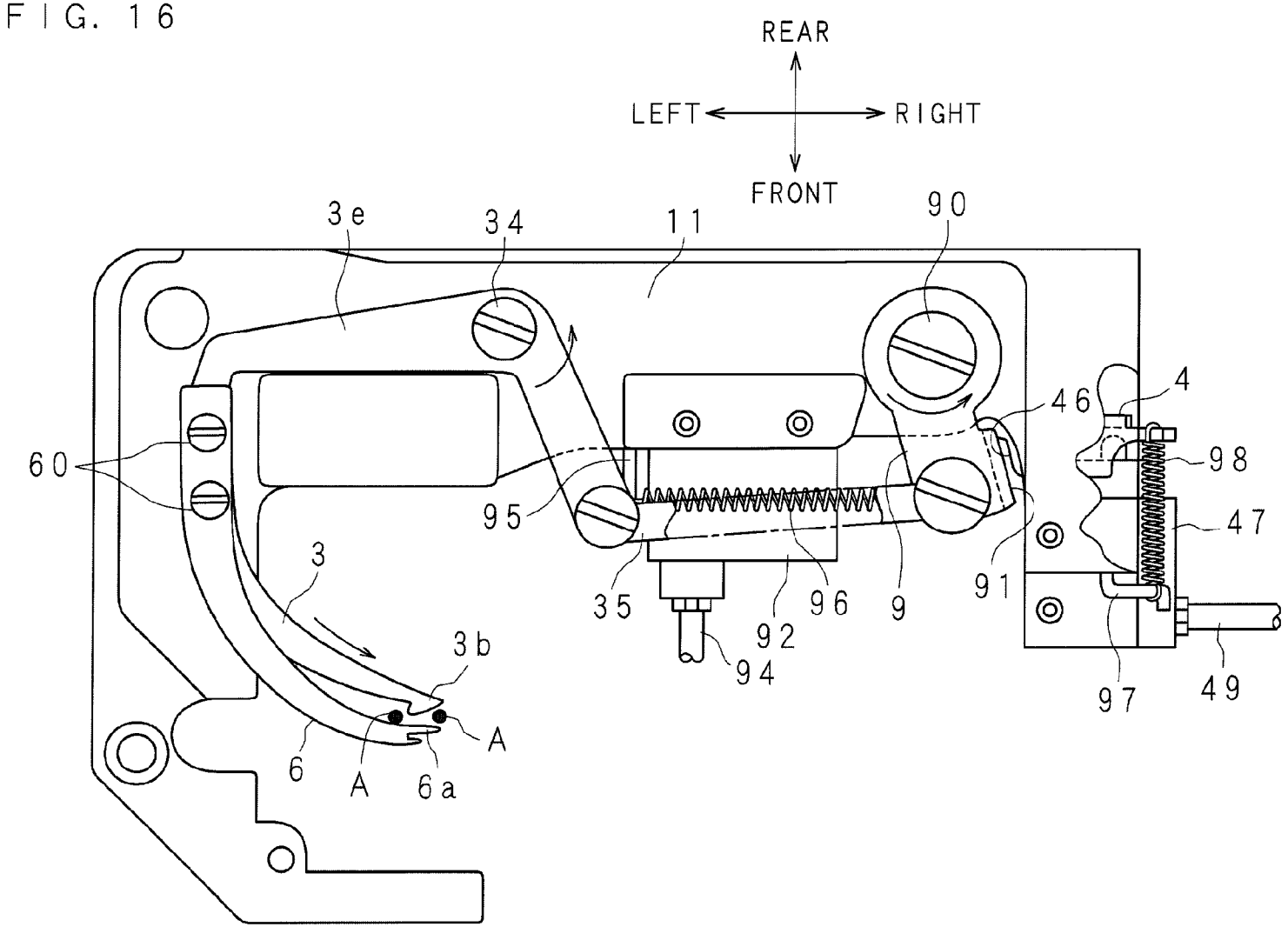
FIG. 16 is an explanatory view showing the operations of the seam ravel preventing apparatus according to Embodiment 2.
Figure 17:
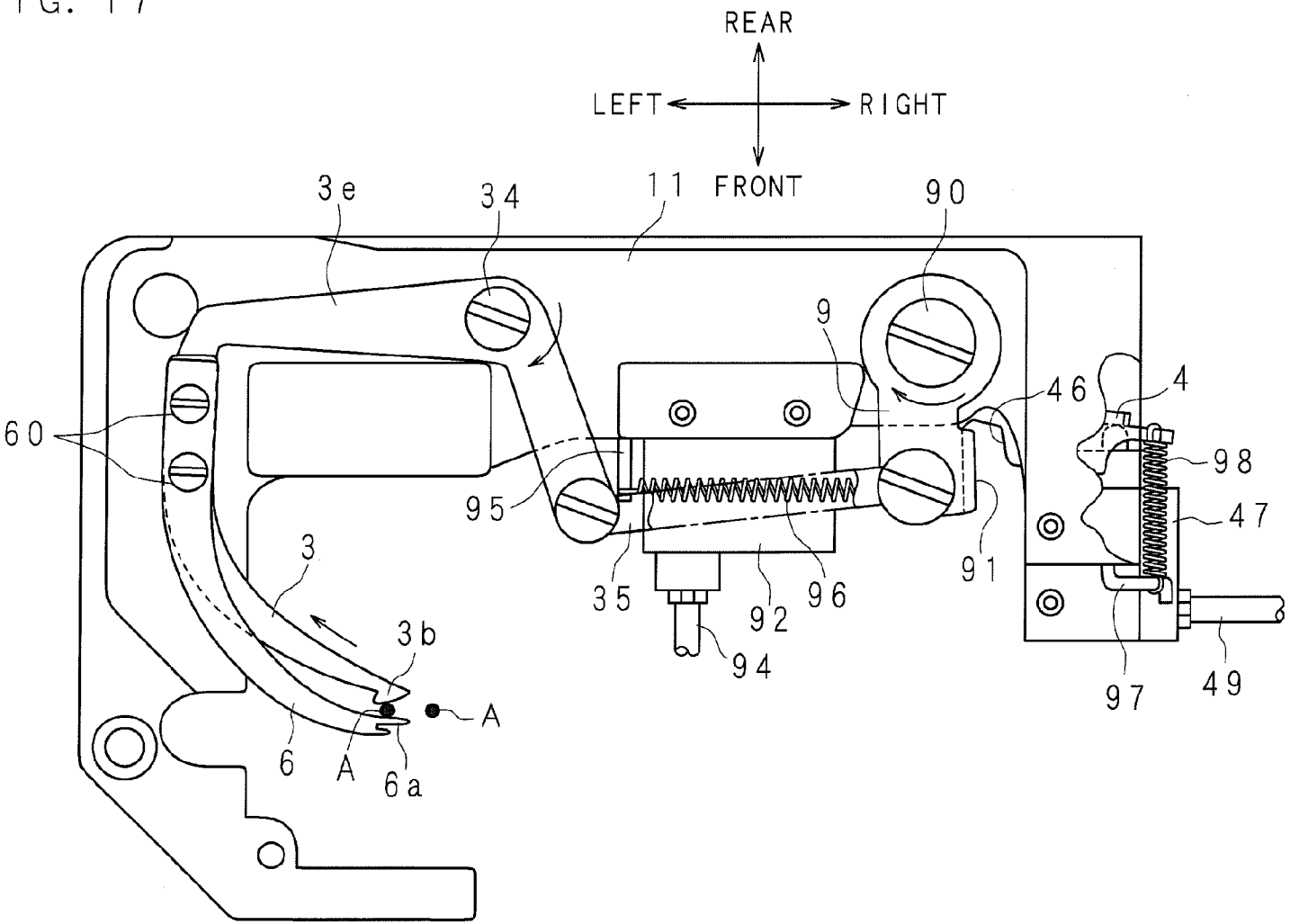
FIG. 17 is an explanatory view showing the operations of the seam ravel preventing apparatus according to Embodiment 2.

FIG. 14 is a plan view schematically showing the configurations of the main parts of a seam ravel preventing apparatus according to Embodiment 2, seen from above, FIG. 15 is also a plan view thereof seen from below, and FIGS. 16 and 17 are also explanatory views showing the operations thereof. In the following descriptions, "left and right" and "front and rear" directions indicated by the arrows shown in FIGS. 16 and 17 are used. As in the cases of FIGS. 2 to 4, the "front" direction is on the side close to the sewing machine operator, and the "rear" direction is on the side away from the sewing machine operator. The "left and right" directions are on the "left and right" sides as viewed from the front.

The ravel preventing apparatus according to Embodiment 2 is equipped with the thread hook 3, the looper thread holder 6 and the stopper lever 4, and is further equipped with a swinging lever 9. As shown in FIG. 14, the thread hook 3 is supported on the upper face of a needle plate base 11 on which the needle plate P is mounted so as to swing around a support shaft 34 extending up and down. The support shaft 34 is positioned on the right rearward side of the needle plate P and near the needle plate P.

The thread hook 3 has a circularly-curved shape and is provided continuing to the tip end part of a support arm 3*e* extending leftward from the support shaft 34 so as to bend forward. The tip end part of the thread hook 3 is located so as to face the needle drop positions A and A of the needles 2 and 2 from the left rearward side on the lower side of the needle plate P, and the hook part 3*b* protruding outward is provided at the tip end part. The support arm 3*e* also extends forward from the support shaft 34, and one-end part of a connecting rod 35 is connected to the extended end.

The looper thread holder 6 has a circularly-curved shape and is mounted on the base part of the thread hook 3 with the two fixing screws 60 and 60 so that its position can be adjusted, as in the case of Embodiment 1. The tip end part of the looper thread holder 6 extends forward along the left side of the thread hook 3 and is located so as to face the needle drop positions A and A in front of the tip end part of the thread hook 3. The bi-forked thread receiving part 6*a* is provided at the tip end part of the looper thread holder 6.

The swinging lever 9 is supported on the upper face of the needle plate base 11, so as to swing around a support shaft 90 extending up and down. The support shaft 90 is positioned away from the support shaft 34 of the thread hook 3 rightward. The swinging lever 9 extends forward from the support shaft 90, and the other end part of the connecting rod 35 is connected to the tip end part of the swinging lever 9.

The swinging lever 9 is equipped with a push plate 91 that is integrally formed by bending its right side near the tip end part downward. As shown in FIG. 15, a thread-handling cylinder 92 is secured to the lower face of the needle plate base 11 on the left side of the swinging lever 9. The thread-handling cylinder 92 is an air cylinder equipped with an output rod 93 protruding rightward. The tip end of the output rod 93 is opposed to the push plate 91. The output rod 93 advances by the action of working air supplied to the thread-handling cylinder 92 via an air tube 94, thereby pushing the push plate 91 rightward.

The needle plate base 11 is equipped with a spring hook rod 95 protruding forward on the left side of the thread-handling cylinder 92. A return spring 96 is suspended between the spring hook rod 95 and the push plate 91. The return spring 96 is a coil spring for pulling and biasing the push plate 91 leftward and is disposed between the connecting rod 35 and the thread-handling cylinder 92. FIGS. 14, 16 and 17 each show a part of the return spring 96 while the middle part of the connecting rod 35 is cut away.

When the thread-handling cylinder 92 is in its non-operating state, the swinging lever 9 is pulled leftward by the spring force of the return spring 96 and is positioned at the swing position shown in FIG. 14. The hook part 3*b* at the tip end of the thread hook 3 and the thread receiving part 6*a* at the tip end of the looper thread holder 6 are positioned at the wait position away from the needle drop positions A and A of the needles 2 and 2 in the left rearward direction as shown in FIG. 14.

When the thread-handling cylinder 92 is operated, the output rod 93 advances and pushes the push plate 91 rightward. By this pushing, the swinging lever 9 swings counterclockwise against the spring force of the return spring 96 as indicated by the arrow shown in FIG. 16. The support arm 3*e* of the thread hook 3 swings counterclockwise around the support shaft 34. The hook part 3*b* at the tip end of the thread hook 3 and the thread receiving part 6*a* at the tip end of the looper thread holder 6 advance in the right forward direction as indicated by the arrow shown in FIG. 16 and reach the thread hook position shown in FIG. 16. As in the case of Embodiment 1, the hook part 3*b* is positioned beyond the needle thread loop on the left side (the advance end side of the looper 1) on the rear side of the looper 1, and the thread receiving part 6*a* is positioned above the looper 1 in front of the hook part 3*b*.

As shown in FIG. 15, the stopper lever 4 is supported on the lower face of the needle plate base 11, so as to swing around a support shaft 44 extending up and down. The support shaft 44 is positioned near the support shaft 90 of the swinging lever 9. The stopper lever 4 extends rightward from the support shaft 44. The stopper lever 4 is equipped with a push plate 45 that is integrally formed by bending the rear side near the tip end part downward and is also equipped with a concave engagement part 46 that is formed by cutting away the middle part of the front edge thereof.

A stopper cylinder 47 is secured to the lower face of the needle plate base 11 near the rear end part thereof. The stopper cylinder 47 is an air cylinder equipped with an output rod 48 protruding rearward. The tip end of the output rod 48 is opposed to the push plate 45. The output rod 48 advances by the action of working air supplied to the stopper cylinder 47 via an air tube 49 and then pushes the push plate 45 rearward.

On the upper face of the needle plate base 11, a spring hook rod 97 is provided so as to protrude rightward on the upper side of the stopper cylinder 47, and a return spring 98 is suspended between the spring hook rod 97 and the tip end part of the stopper lever 4. The return spring 98 is a coil spring for pulling and biasing the tip end part of the stopper lever 4 rearward. FIGS. 14, 16 and 17 show the connection part between the return spring 98 and the stopper lever 4 while a part of the needle plate base 11 is cut away.

When the stopper cylinder 47 is in its non-operating state, the stopper lever 4 is pulled forward by the spring force of the return spring 98 and is located at the position where the front edge thereof is pushed against the push plate 91 of the swinging lever 9 as shown in FIG. 15. When the thread-handling cylinder 92 is operated in this state, the push plate 91 moves rightward along the front edge of the stopper lever 4. When the moving push plate 91 is aligned with the concave engagement part 46 provided at the front edge, the stopper lever 4 is pulled by the spring force of the return spring 98 and swings counterclockwise as shown in FIG. 15, whereby the sewing machine is in a state in which the bottom face of the concave engagement part 46 is pushed against the push plate 91 of the swinging lever 9 as shown in FIG. 16.

When the thread-handling cylinder 92 becomes a non-operating state in this state, the swinging lever 9 is pulled leftward by the spring force of the return spring 96 and swings clockwise as indicated by the arrow in FIG. 17. By virtue of this swinging, the push plate 91 moves slidingly inside the concave engagement part 46 of the stopper lever 4, and the push plate 91 is restrained at the position where the push plate 91 is engaged with the left edge of the concave engagement part 46. At this time, the thread hook 3 and the looper thread holder 6 swing clockwise around the support shaft 34, and the hook part 3*b* at the tip end of the thread hook 3 and the thread receiving part 6*a* at the tip end of the looper thread holder 6 move so as to retract in the left rearward direction and are located at the hold position close to the thread hook position. During the movement, as in the case of Embodiment 1, the hook part 3*b* catches and pulls back the left needle thread loop and positions it on the advance end side of the looper 1, and the thread receiving part 6*a* pushes the looper thread extending from the looper 1 to the cloths and positions it on the front side away from the fall position of the needle 2.

When the stopper cylinder 47 has operated in this state, the output rod 48 advances and pushes the push plate 45 of the stopper lever 4 rearward. By the pushing, the stopper lever 4 swings against the spring force of the return spring 98. The concave engagement part 46 provided in the stopper lever 4 moves rearward and is disengaged from the push plate 91. As a result, the swinging lever 9 swings clockwise by the action of the spring force of the return spring 96, the thread hook 3 moves in the left rearward direction from the hold position shown in FIG. 17, and returns to the wait position shown in FIG. 14. When the stopper cylinder 47 becomes a non-operating state, the stopper lever 4 swings by the action of the spring force of the return spring 98 and returns to the swing position shown in FIG. 14.

In the seam ravel preventing apparatus according to Embodiment 2, the thread hook 3 and the looper thread holder 6 move among the wait position, the thread hook position and the hold position by selectively operating the thread-handling cylinder 92 and the stopper cylinder 47, whereby a ravel preventing method similar to that according to Embodiment 1 can be performed. The thread-handling cylinder 92 serves as a hook actuator, and the stopper cylinder 47 serves as a stopper actuator.

The operation of the seam ravel preventing apparatus according to Embodiment 2 can be attained by using the thread-handling cylinder 92 and the stopper cylinder 47 as control targets, more specifically, by using air supply/exhaust valves for supplying/exhausting working air to the thread-handling cylinder 92 and the stopper cylinder 47 as control targets and by performing control operations similar to those described in the time chart shown in FIG. 6 using the control section 8 constructed as shown in FIG. 5.

Figure 18:
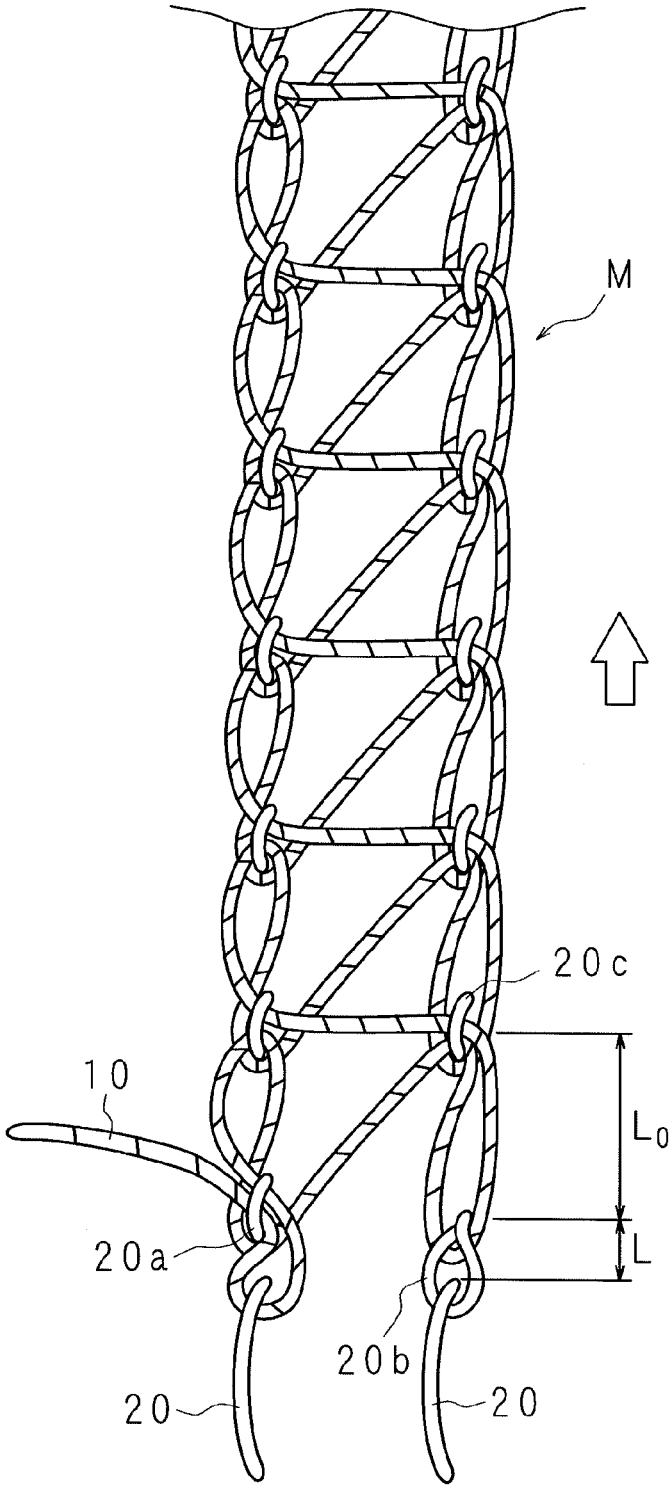
FIG. 18 is a view showing the seam structure of twin-needle multi-thread chain stitching obtained by the present invention, seen from the back side of sewn cloths.
Figure 19:
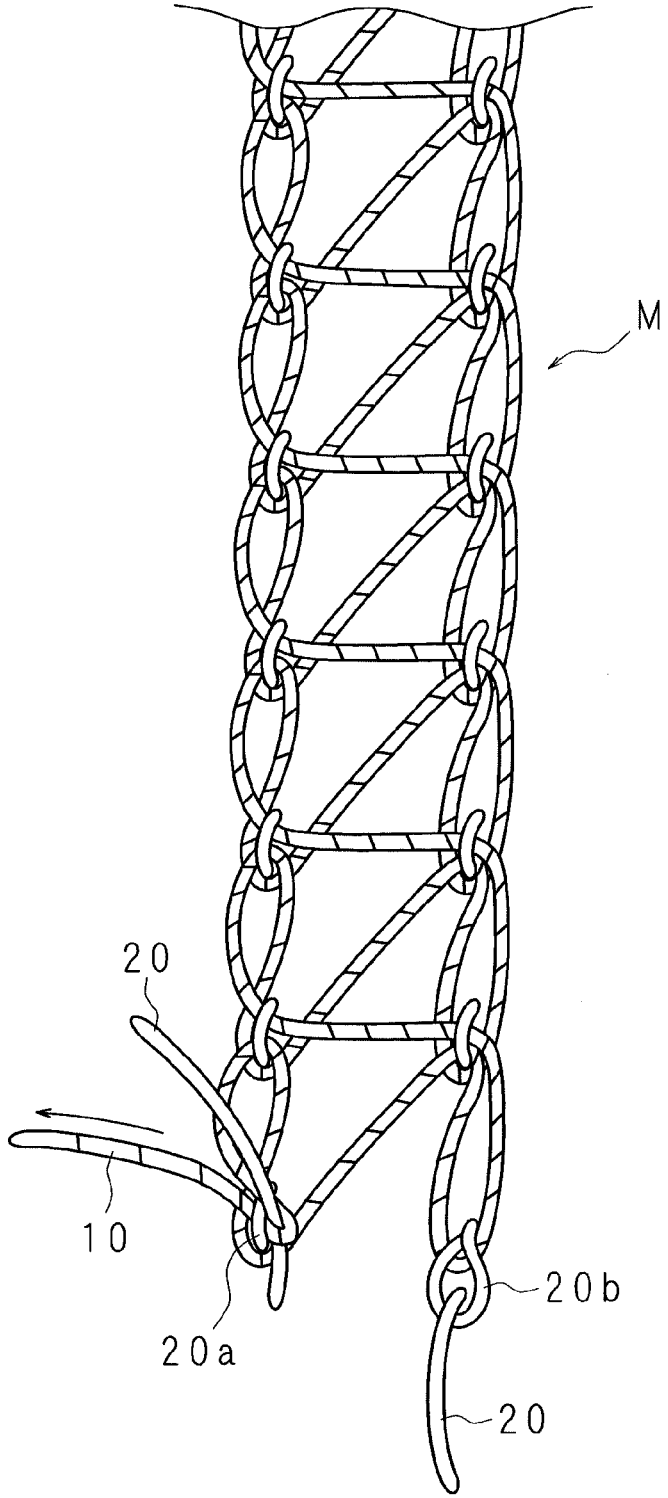
FIG. 19 is an explanatory view illustrating the ravel preventing effect of the seam structure shown in FIG. 18.

FIG. 18 is a view showing the seam structure of twin-needle multi-thread chain stitching obtained by the present invention, seen from the back side of the sewn cloths, and FIG. 19 is an explanatory view illustrating the ravel preventing effect of the seams shown in FIG. 18. Although the left-right relationship in these figures is opposite to that in FIGS. 7 to 13, the left and right directions in FIGS. 7 to 13 are used in the following descriptions. Furthermore, in FIGS. 18 and 19, the feeding direction of the cloths is the direction indicated by the hollow arrow. In FIGS. 18 and 19, the upper side corresponds to the downstream side in the feeding direction, and the lower side corresponds to the upstream side in the feeding direction.

As shown in FIG. 18, the looper thread 10 passes through the needle thread loop 20*a* (hereafter referred to as the right last loop 20*a*) on the right side (the left side in FIG. 18) formed on the back side of the sewn cloths at the last seam of seams M of the multi-thread chain stitching and is turned back in front of the needle thread 20 positioned on the same side and slipping out to the back side of the sewn cloths when one stitch is sewn for ravel prevention and then passes through the right last loop 20*a* again. At this position, the looper thread 10 is cut.

On the other hand, as described above, the needle thread 20 on the left side (the right side in FIG. 18) getting out to the back side of the cloths when the cloths are sewn for one stitch, passes through the left needle thread loop 20*b* (hereafter referred to as the left last loop 20*b*) formed last on the back side of the cloths to be sewn when usual sewing is performed, and is subjected to self-looping with the left last loop 20*b*, whereby a seam of single-thread chain stitching is formed. As a result, the looper thread 10 is in a state of being held between the left needle thread 20 and the left last loop 20*b* as shown in the figure.

In FIGS. 18 and 19, the left last loop 20*b* is shown in a loose state to clearly indicate the state of intertwining with the needle thread 20. However, the actual left last loop 20*b* is tightened after the needle thread 20 has passed and has a state similar to that of the right last loop 20*a*. As a result, the looper thread 10 is firmly held with the needle thread 20 and the left last loop 20*b*, thereby being restrained in a state of being extended between the left last loop 20*b* and the left needle thread loop 20*c* formed immediately before the last time as shown in the figure. Since this restraining is maintained for the acting forces of any directions applied to the looper thread 10, the occurrence of ravel peculiar to the seams M of the multi-thread chain stitching can be prevented securely at the stage of the occurrence.

As described above, the feed pitch of the cloths to be sewn at the time of sewing for one stitch is smaller than the feed pitch of the cloths to be sewn at the time of usual sewing. Hence, as shown in FIG. 18, the distance L between the get-out position of the needle thread 20 and the left last loop 20*b* at the time of sewing for one stitch becomes smaller than the distance $L_0$ between the left last loop 20*b* and the left needle thread loop 20*c* formed immediately before the last time. As a result, the holding of the looper thread 10 between the left needle thread 20 and the left last loop 20*b* is strengthened, whereby the occurrence of ravel due to the slipping-out of the looper thread 10 can be prevented securely.

From the viewpoint of strengthening the holding of the looper thread 10, it is desirable that the distance L should be as small as possible. On the other hand, when the distance L is small, there is a problem that the strength between the get-out position of the needle thread 20 and the left last loop 20*b* is insufficient for thin cloths to be sewn for example and that the cloths may be damaged. For this reason, the distance L, that is, the feed pitch of the cloths to be sewn at the time of sewing for one stitch is required to be set properly depending on the type of the cloths to be sewn.

FIG. 19 shows a state in which the cut end portion of the looper thread 10 is pulled in the direction indicated by the arrow in the figure. When the pulling is performed, the loop of the looper thread 10 passing in front of the needle thread 20 on the same side becomes small and pulled into the right last loop 20*a* as described above. As a result, the needle thread 20 is in a state of being held between the looper thread 10 and the right last loop 20*a*, and such a "knot" as shown in the figure is formed by the needle thread 20 and the looper thread 10. This "knot" applies resistance to the looper thread 10 and acts to prevent the looper thread 10 from slipping out. Hence, when the state shown in FIG. 19 is obtained, the ravel of seams of the multi-thread chain stitching can be prevented further securely by virtue of the synergic action between the self-looping portion on the left side and the "knot" on the right side.

In the seams configured as described above, the length of the cut end portion of the looper thread 10 protruding from the right last loop 20*a* is sufficiently short as shown in FIG. 19. Hence, the sewing operator can form high-quality seams having attractive appearance without requiring any treatment at the cut end portion.

Figure 20:
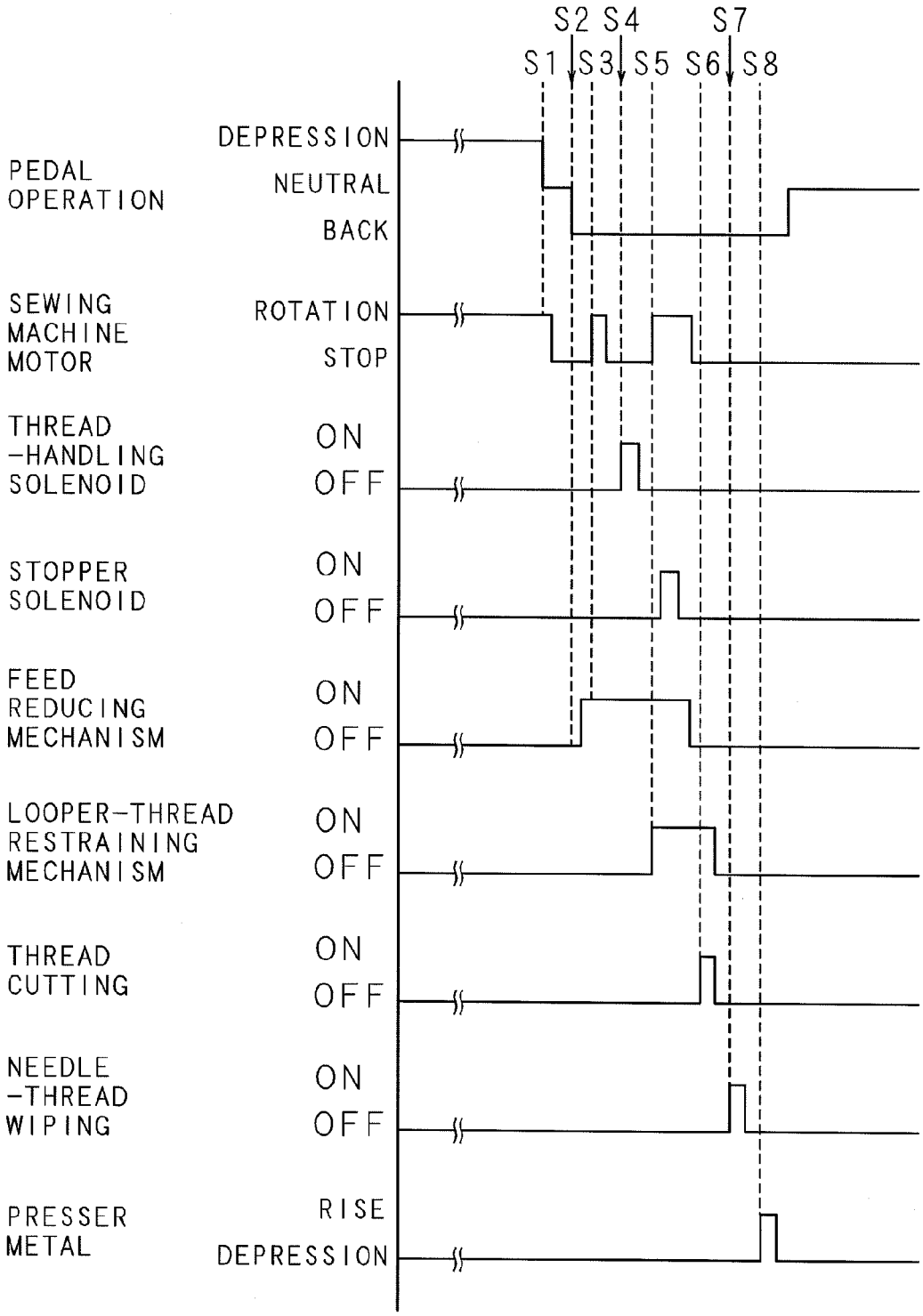
FIG. 20 is a time chart indicating the operations of a control section according to another embodiment.

In the embodiments described above, the feed pitch of the cloths to be sewn is changed while sewing for one stitch for self-looping is performed. However, this change may be performed from the stage before the sewing for one stitch. FIG. 20 is a time chart showing another embodiment of the operations of the control section 8.

When the ravel preventing operation is performed, the sewing operator returns the pedal to its neutral position at the end of the sewing work and then performs pedal back operation, as described above. When the sewing of the cloths to be sewn is completed and when the pedal is returned to the neutral state at time S1 shown in FIG. 20, the control section 8 refers to the needle position signal 22 given to the input side and issues a stop instruction to the sewing machine motor 80 on the output side. In this embodiment, the sewing machine stops temporarily in a state in which the needles 2 and 2 have fallen near the bottom dead points and the looper 1 has retracted rightward. The control section 8 waits until the pedal back operation is performed. When the pedal back operation is performed at time S2 shown in FIG. 20 and the pedal back signal 21*b* is given to the input side, the control section 8 starts the ravel preventing operation as described below.

As described above in the explanation referring to FIG. 6, the maintenance of the neutral state of the pedal from time S1 to time S2 is not an essential operation, and the continuation of the pedal back operation after time S2 is not an essential operation either. In these cases, the control section 8 starts ravel preventing operation described below by using the no-signal state occurring when the pedal passes the neutral position as a trigger, more specifically, by using the state in which neither the pedal depression signal 21*a* nor the pedal back signal 21*b* is given as a trigger, and such an operation is continued after the input of the pedal back signal 21*b* is stopped.

The control section 8, having stared the ravel preventing operation, first gives an operation instruction to the feed reducing mechanism 83 and then gives an operation instruction to the sewing machine motor 80 at time S3. These operation instructions are given with reference to the needle position signal 22 while the needles 2 and 2 rise from the stop positions and are positioned near the top dead points. As a result, the cloths are sewn for half stitch. This sewing operation is performed while the feed pitch is made smaller than that used during usual sewing since the feed reducing mechanism 83 is in an operating state.

By the above-mentioned operations, there occurs a state in which the needles 2 and 2 have risen near the top dead points and the looper 1 has advanced near the left advance end. Then, the control section 8 gives an operation instruction to the thread-handling solenoid 32 on the output side to magnetize the thread-handling solenoid 32 for a short time at time S4, and then gives operation instructions to the sewing machine motor 80 and the looper-thread restraining mechanism 84 on the output side at time S5.

The operation instruction to the sewing machine motor 80 is given with reference with the needle position signal 22 while the needles 2 and 2 positioned at the top dead points fall and then rise and are positioned near the top dead points again. As a result, the cloths to be sewn are sewn for one stitch. At this time, the operation of the feed reducing mechanism 83 continues, and the looper-thread restraining mechanism 84 operates. Hence, the sewing for one stitch is performed at a feed pitch smaller than that used during usual sewing and in a state in which the feeding of the looper thread 10 to the looper 1 is restrained.

Then, the control section 8 issues an operation instruction to the thread cutting actuator 58 at time S6, an operation instruction to the air wiper 82 at time S7, and an operation instruction to the cloth presser cylinder 81 at time S8. The control section 8 operates the thread cutting actuator 58, the air wiper 82 and the cloth presser cylinder 81 and then completes the series of operations. The operations performed between time S4 to time S8 shown in FIG. 20 are the same as the operations performed between time S2 to time S6 shown in FIG. 6. During the operations, sewing for one stitch for self-looping is performed, the needle threads 20 and 20 and the looper thread 10 are cut by the thread cutting mechanism 5, the cut needle threads 20 and 20 are wiped up by the operation of the air wiper 82, and the presser metal is raised by the operation of the cloth presser cylinder 81.

Figure 21:
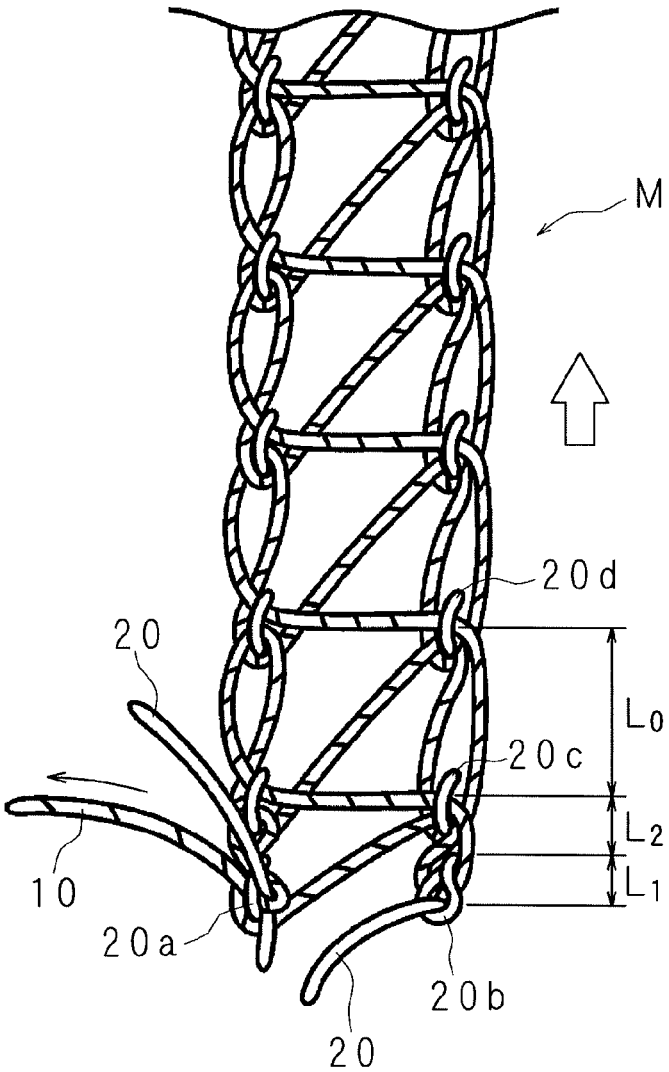
FIG. 21 is a view showing the seam structure of twin-needle multi-thread chain stitching obtained by the operations shown in FIG. 20, seen from the back side of sewn cloths.

FIG. 21 is a view showing the seam structure of twin-needle multi-thread chain stitching obtained by the above-mentioned operations, seen from the back side of the sewn cloths. Like FIG. 19, FIG. 21 shows a state in which the cut end portion of the looper thread 10 is pulled in the direction indicated by the arrow in the figure. The ravel of seams M of the multi-thread chain stitching can be prevented securely by virtue of the synergic action between the self-looping portion on the left side (the right side in FIG. 21) and the "knot" on the right side (the left side in FIG. 21).

In this embodiment, before the sewing for one stitch for self-looping, sewing for half stitch is performed in a state in which the feeding amount of the cloths to be sewn is reduced. As a result, in the seam structure shown in FIG. 21, not only the distance $L_1$ between the get-out position of the last needle thread 20 and the left last loop 20*b* but also the distance $L_2$ between the left last loop 20*b* and the left needle thread loop 20*c* formed immediately before the left last loop 20*b* becomes smaller than the distance $L_0$ between the left needle thread loop 20*c* and the left needle thread loop 20*d* formed immediately before the left needle thread loop 20*c*. Hence, the self-looping portion and the inter-looping portions ahead of the self-looping portion become dense. As a result, the holding of the looper thread 10 is strengthened further, and the occurrence of ravel starting from the slipping-out of the looper thread 10 at the sewing end portion can be prevented further securely.

In the above-mentioned embodiments, the seams of the multi-thread chain stitching formed by the two needle threads 20 and 20 and the looper thread 10 have been described. However, the seam ravel preventing apparatus and the seam ravel preventing method performed using the apparatus according to the present invention can also be applied similarly to seams of multi-needle multi-thread chain stitching in which three or more needle threads are used, and the occurrence of ravel can be prevented effectively.

Furthermore, in the above-mentioned embodiments, a case has been described in which one of the needle thread loops formed by the two needle threads 20 and 20, that is, one needle thread loop positioned on the advance end side of the looper 1, is caught and sewing for one stitch is performed in this state. However, the number of the needle thread loops to be caught may be plural including the one needle thread loop on the advance end side of the looper 1. Moreover, the sewing for two or more stitches may be performed in such a state in which the plural needle thread loops are caught.

In addition, in the above-mentioned embodiments, the thread hook 3 is designed to move between the left rear side and the right front side of the needle drop position A and catch the needle thread 20. However, the thread hook 3 may be designed to catch the needle thread 20 through a movement other than the above-mentioned movement. Besides, the needle thread 20 is not limited to be caught on the rear side of the looper 1 as described in the embodiments, but the needle thread 20 may be caught on the front side of the looper 1. Furthermore, in the present invention, as described in the appended claims, the needle thread loop should only be positioned on the advance end side of the looper 1 away from the fall position of the needle 2. The holding of the needle thread 20 using the thread hook 3 described in the embodiments is not an essential operation.

Still further, in the above-mentioned embodiments, the looper thread holder 6 is mounted on the thread hook 3 and operates integrally with the thread hook 3 to hold the looper thread 10. However, the looper thread holder 6 can be configured so as to hold the looper thread 10 through an operation other than the above-mentioned operation. The looper thread holder 6 may be provided separately from the thread hook 3 and operated by a dedicated actuator different from the thread hook 3. Moreover, in the present invention, as described in the appended claims, the looper thread 10 should only be positioned on the front side of the fall position of the needle 2. The holding of the looper thread 10 using the looper thread holder 6 described in the embodiments is not an essential operation.

The invention claimed is:

1. A seam ravel preventing method for preventing ravel of a seam of multi-thread chain stitching formed when a needle thread loop formed under a needle plate by a needle that moves up and down while holding a needle thread is caught by a looper advancing in a direction substantially orthogonal to an up-down movement pathway of the needle and then the needle thread loop is subjected to inter-looping with a looper thread held by the looper, said seam ravel preventing method comprising:

a first step of, when sewing of a cloth is completed, advancing the looper, positioning a needle thread loop caught by the looper on an advance end side of the looper away from a fall position of the needle, and positioning a looper thread extending from the looper to the cloth on a front side away from the fall position of the needle; and a second step of, after the first step, performing sewing for at least one stitch while maintaining positions of the needle thread loop and the looper thread until the needle falls and passes through the needle thread loop, and subjecting the needle thread loop held by the looper to self-looping with the needle thread held by the needle.

2. The seam ravel preventing method according to claim 1, wherein the needle thread loop caught by the looper is positioned on the advance end side of the looper away from the fall position of the needle on a rear side or a front side of the looper.

3. The seam ravel preventing method according to claim 1, wherein a plurality of the needles are disposed in a direction in which the looper advances, and at least one of a plurality of needle thread loops formed by the respective needles, including the needle thread loop positioned on the advance end side of the looper, is positioned on the advance end side of the looper away from the fall positions of the needles.

4. The seam ravel preventing method according to claim 1, wherein the sewing for at least one stitch at the second step is performed while feeding of the cloth is stopped or a feed pitch of the cloth is made smaller than that used before the first step.

5. The seam ravel preventing method according to claim 4, wherein stop of the feeding of the cloth or feeding of the cloth at the feed pitch smaller than that used before the first step is performed from a stage before the sewing for at least one stitch at the second step.

6. The seam ravel preventing method according to claim 1, wherein after the looper thread is positioned on the front side away from the fall position of the needle, feeding of the looper thread to the looper is restrained.

7. A seam structure of multi-thread chain stitching formed on a cloth using the seam ravel preventing method according to claim 1, wherein a needle thread loop, at least located last in a sewing direction, of needle thread loops formed on a back side of the cloth is subjected to self-looping with a needle thread passing through the cloth.

8. A seam ravel preventing apparatus for preventing ravel of a seam of multi-thread chain stitching, said seam ravel preventing apparatus being installed in a sewing machine which comprises a needle that moves up and down while holding a needle thread and a looper that holds a looper thread and advances and retracts in a direction substantially orthogonal to an up-down movement pathway of the needle and in which a needle thread loop formed under a needle plate by the needle is caught by the advancing looper and the needle thread loop is subjected to inter-looping with the looper thread held by the looper to form a seam of multi-thread chain stitching on a cloth, said seam ravel preventing apparatus comprising:

a needle-thread holding mechanism that approaches to and recedes from the looper, and holds a needle thread loop caught by the looper on an advance end side of the looper away from a fall position of the needle when the needle-thread holding mechanism approaches to the looper;

a looper-thread holding mechanism that approaches to and recedes from the looper, and holds a looper thread extending from the looper to a cloth on a front side away from the fall position of the needle; and a control section for controlling approaching/receding of the needle-thread holding mechanism and the looper-thread holding mechanism in association with operations of the needle and the looper and feeding of the cloth, wherein after first sewing is completed with the looper located at an advance position thereof and the needle located at a rise position thereof, the control section causes the needle-thread holding mechanism and the looper-thread holding mechanism to approach to the looper and hold a needle thread loop and a looper thread respectively, and provides control of maintaining a state where the needle-thread holding mechanism and the looper-thread holding mechanism hold the needle thread loop and the looper thread respectively until the needle falls and passes through the needle thread loop and performing second sewing for at least one stitch in the maintained state while synchronizing falling/rising of the needle with advancing/retracting of the looper and the feeding of the cloth.

9. The seam ravel preventing apparatus according to claim 8, wherein when a plurality of the needles are disposed in a direction in which the looper advances, the needle-thread holding mechanism holds at least one needle thread loop including the needle thread loop formed by the needle positioned on the advance end side of the looper.

10. The seam ravel preventing apparatus according to claim 8, wherein for the second sewing for at least one stitch, the control section sets a feed pitch of the cloth to zero or a value smaller than that used for the first sewing.

11. The seam ravel preventing apparatus according to claim 10, wherein the control section sets the feed pitch of the cloth to zero or a value smaller than that used for the first sewing from a stage before the second sewing for at least one stitch.

12. The seam ravel preventing apparatus according to claim 8, wherein the needle-thread holding mechanism comprises:

a thread hook and a stopper lever that are disposed under the needle plate and swing on a plane substantially parallel with the needle plate;

a hook actuator for swinging the thread hook from a wait position away from the looper, to a thread hook position close to the looper; and a stopper actuator for swinging the stopper lever from a retraction position away from a range in which the thread hook swings, to a restraint position for making contact with a part of the thread hook, wherein the control section selectively controls the hook actuator and the stopper actuator to cause the thread hook to hold the needle thread loop caught at the thread hook position by the thread hook, at a hold position between the thread hook position and the wait position by contact with the stopper lever.

13. The seam ravel preventing apparatus according to claim 12, wherein the looper-thread holding mechanism comprises a looper thread holder that is mounted on the thread hook and moves among the thread hook position, the hold position and the wait position together with the thread hook, and the looper thread holder catches the looper thread extending from the looper to the cloth while moving from the wait position to the thread hook position, and holds the caught looper thread at the hold position on the front side away from the fall position of the needle.

14. The seam ravel preventing apparatus according to claim 13, wherein the looper thread holder is mounted so that a position thereof is adjustable with respect to the thread hook.

15. The seam ravel preventing apparatus according to claim 8, wherein the needle-thread holding mechanism comprises:

a thread hook that is disposed under the needle plate and swings on a plane substantially parallel with the needle plate;

a swinging lever and a stopper lever that are disposed at positions further away from the needle plate than the thread hook and swing on a plane substantially parallel with the needle plate;

a connecting rod for connecting the thread hook to the swinging lever;

a hook actuator for acting on the thread hook via the connecting rod and for swinging the thread hook from a wait position away from the looper, to a thread hook position close to the looper; and a stopper actuator for swinging the stopper lever from an engagement position where the stopper lever is engaged with a part of the swinging lever, to a retraction position away from the engagement position, and wherein the control section selectively controls the hook actuator and the stopper actuator to cause the thread hook to hold the needle thread loop caught at the thread hook position by the thread hook, at a hold position between the thread hook position and the wait position by engagement of the stopper lever and the swinging lever.

16. The seam ravel preventing apparatus according to claim 15, wherein the looper-thread holding mechanism comprises a looper thread holder that is mounted on the thread hook and moves among the thread hook position, the hold position and the wait position together with the thread hook, and the looper thread holder catches the looper thread extending from the looper to the cloth while moving from the wait position to the thread hook position, and holds the caught looper thread at the hold position on the front side away from the fall position of the needle.

17. The seam ravel preventing apparatus according to claim 16, wherein the looper thread holder is mounted so that a position thereof is adjustable with respect to the thread hook.

18. A seam structure of multi-thread chain stitching formed on a cloth using the seam ravel preventing apparatus according to claim 8, wherein a needle thread loop, at least located last in a sewing direction, of needle thread loops formed on a back side of the cloth is subjected to self-looping with a needle thread passing through the cloth.

* * * * *